US010842275B2

(12) United States Patent
Kinoshita et al.

(10) Patent No.: US 10,842,275 B2
(45) Date of Patent: Nov. 24, 2020

(54) CHAIR AND COVER MEMBER OF THE CHAIR

(71) Applicant: KOKUYO CO., LTD., Osaka (JP)

(72) Inventors: Yojiro Kinoshita, Osaka (JP); Hideshi Hamaguchi, Portland, OR (US); Ippei Iwahara, Portland, OR (US)

(73) Assignee: KOKUYO CO., LTD., Osaka (JP)

( * ) Notice: Subject to any disclaimer, the term of this patent is extended or adjusted under 35 U.S.C. 154(b) by 0 days.

(21) Appl. No.: 16/464,828

(22) PCT Filed: Dec. 19, 2017

(86) PCT No.: PCT/JP2017/045516
§ 371 (c)(1),
(2) Date: May 29, 2019

(87) PCT Pub. No.: WO2018/117097
PCT Pub. Date: Jun. 28, 2018

(65) Prior Publication Data

US 2019/0290006 A1 Sep. 26, 2019

(30) Foreign Application Priority Data

Dec. 20, 2016 (JP) ..... 2016-247238

(51) Int. Cl.
*A47C 3/025* (2006.01)
*A47C 3/026* (2006.01)
(Continued)

(52) U.S. Cl.
CPC ..... *A47C 3/026* (2013.01); *A47C 7/00* (2013.01); *A47C 7/14* (2013.01)

(58) Field of Classification Search
CPC ..... A47C 3/026; A47C 7/00; A47C 7/14
(Continued)

(56) References Cited

U.S. PATENT DOCUMENTS 4,555,085 A * 11/1985 Bauer ..... A47C 3/026 248/371
4,575,151 A * 3/1986 Edstrom ..... A47C 7/445 297/303.3
(Continued)

FOREIGN PATENT DOCUMENTS

CA 3044190 A1 * 6/2018 ..... A47C 3/026
EP 2862482 B1 * 5/2016 ..... A47C 3/22
(Continued)

OTHER PUBLICATIONS

International Search Report dated Mar. 6, 2018, issued in counterpart International Application No. PCT/JP2017/045516 (1 page).
(Continued)

*Primary Examiner* — Rodney B White
(74) *Attorney, Agent, or Firm* — Westerman, Hattori, Daniels & Adrian, LLP

(57) ABSTRACT

[Problem]
The present invention provides a chair and a cover member of the chair that include a cover which can appropriately maintain the appearance of the chair while preventing a sitting person from touching a movement mechanism moving below a seat at the time of movement of the seat or a backrest.
[Means for Solving the Problem]
A chair according to the present invention is provided with cover members 71, 72 for covering a movement mechanism 5 to support a seat movably at least one direction of front-rear direction and left-right direction, and is configured so that the cover members 71, 72 include a plurality of through-holes 71*x*, 72*x* arranged lengthwise and breadthwise.

7 Claims, 21 Drawing Sheets

(51) Int. Cl.
*A47C 7/14* (2006.01)
*A47C 7/00* (2006.01)

(58) Field of Classification Search
USPC ..... 297/314
See application file for complete search history.

(56) References Cited

U.S. PATENT DOCUMENTS 4,664,352 A * 5/1987 Shibuki ..... B60N 2/502 188/266.7
5,035,466 A * 7/1991 Mathews ..... A47C 1/023 297/337
5,951,109 A * 9/1999 Roslund, Jr. ..... A47C 1/03255 297/299
6,523,897 B2 * 2/2003 Pan ..... A47C 1/022 297/300.2
6,685,268 B2 * 2/2004 Meyer ..... A47C 7/448 297/314 X
6,688,689 B1 * 2/2004 Thorn ..... A47C 3/0252 297/314 X
6,979,059 B1 * 12/2005 Conlin ..... A47C 3/026 297/314
7,100,983 B1 * 9/2006 Gant ..... A47C 3/025 297/314 X
8,029,060 B2 * 10/2011 Parker ..... A47C 1/023 297/314 X
8,439,442 B2 * 5/2013 Highlander ..... A47C 7/14 297/314 X
8,857,909 B2 * 10/2014 Bock ..... A47C 3/026 297/302.2
10,058,180 B2 * 8/2018 Desanta ..... A47C 7/448
2007/0040433 A1 * 2/2007 Huang ..... A47C 1/03238 297/325
2009/0278388 A1 * 11/2009 Reingewirtz ..... A47C 3/025 297/314
2012/0256458 A1 10/2012 Gehner et al.
2018/0279785 A1 * 10/2018 Moreschi ..... A47C 1/03272
2019/0045928 A1 * 2/2019 Yajima ..... A47C 1/024
2019/0208910 A1 * 7/2019 Sugano ..... A47C 3/18
2019/0343286 A1 * 11/2019 Sugano ..... A47C 3/027

FOREIGN PATENT DOCUMENTS

JP 3175554 U 5/2012
JP 2012-217845 A 11/2012
JP 5187738 B2 4/2013
JP 2015-84859 A 5/2015
KR 10-2014-0035312 A 3/2014

OTHER PUBLICATIONS

Office Action dated May 19, 2020, issued in counterpart JP Application No. 2016-247238, with English Translation. (7 pages).
Office Action dated Jul. 14, 2020, issued in counterpart JP Application No. 2016-247238, with English Translation. (7 pages).

* cited by examiner

CHAIR AND COVER MEMBER OF THE CHAIR

TECHNICAL FIELD

The present invention relates to a chair suitable for office use or the like and a cover member of the chair.

BACKGROUND ART

Many chairs such as swivel chairs for office use, which are intended for a sitting person to maintain a comfortable sitting posture for a long time in an office, at home, or the like have been conventionally proposed (for example, see Patent Document 1).

Each of the swivel chairs for office use is configured to move a seat or a backrest in accordance with mainly backward or forward tilting of a sitting person such that the sitting person can comfortably act while doing work.

Some of the office chairs have been proposed as chairs each provided with a cover member for covering a mechanism for acting as the movement of the seat or the backrest and to cover the mechanism the seat for the purpose of effectively avoiding a user's body, clothes, or the like from touching the mechanism during the movement of the seat or the backrest. Such a chair can not only avoid a problem that a sitting person may touch the mechanism, but also apparently cover the mechanism and have an outline matching a preference of a consumer as a user. In addition, it is can be realized that the chair enables the sitting person to feel comfortable, and the chair can apparently look smart and satisfy a preference of the sitting person.

CITATION LIST

Patent Literature

Patent Document 1: Japanese Patent No. 5187738

SUMMARY OF THE INVENTION

Problem to be Solved by the Invention

Currently, for the purpose of further improving sitting comfort of a sitting person compared to a conventional chair, a chair configured to perform various movements of a seat or a backrest has been proposed. In the chair configured as just described, it is conceivable that the outline of a movement mechanism configured to movably support the seat or the backrest also largely changes in accordance with the movement of the seat or the backrest.

However, if a cover member prevents a sitting person from touching the movement mechanism from the outside, the shape of the cover member needs to be set in consideration of all movement trajectories of the movement function. Accordingly, the more various the movement of the seat or the backrest is, the larger the outline of the cover member becomes and as a result, there is a possibility that a heavy-weight feeling or a blocked feeling is increased and the appearance of the chair does not match a consumer's preference.

The present invention is thus intended to solve the above problems, and also to provide a chair and a cover member of the chair that include a cover which can appropriately maintain the appearance of the chair while preventing a sitting person from touching with a movement mechanism moving below a seat at the time of movement of the seat or a backrest.

Means for Solving the Problem

The following means are taken in the present invention to achieve the object.

In other words, a chair according to the present invention includes one or a plurality of cover members for covering a movement mechanism to support a seat movably at least one direction of front-rear direction and left-right direction, and the cover member includes a plurality of through-holes arranged lengthwise and breadthwise, and the through-holes are arranged on the surfaces surrounding the movement mechanism and also arranged so that when one of the through-holes is viewed from the outer surface side, other through-holes can be visually recognized from inner surface side.

Here, "through-hole" is arranged by penetrating a material of which a cover member is made. If the through-hole is configured such that an opposite side can be visually recognized in some degree and light from the opposite side can be recognized, it is not particularly limited.

With such a configuration, while preventing the movement mechanism from touching a sitting person, even if outline of the cover members is increased in size or a plurality of the cover members are overlapped, it is possible to secure a clear see-through feeling and a light-weight feeling below the seat through the through-holes and to prevent an original appearance of the chair to which the chair is given in accordance with consumer's preference from being damaged. Especially, when there are surfaces surrounding the movement mechanism, a heavy-weight feeling or a blocked feeling in a wide range is easily obtained. However, when the through-holes are arranged as above mentioned, the light shining in through other through-holes can be visually recognized and thus, the effective result of the clear see-through feeling or the light-weight feeling can be obtained.

In addition, if the through-hole is arranged so that the movement mechanism can be visually recognized from the outside, it is possible to configure a mechanical design appearance by using silhouette of the movement mechanism and the position of the movement mechanism is easily recognized in appearance, and thus, it can be easily designed so that the condition of movement can be checked or that the movement mechanism can be oiled through the through-hole.

Further, as a concrete configuration for preventing fingers or foreign materials into the through-hole from inserting by mistake, the through-hole is designed in size and shape such that a cylinder with 8 mm in diameter is not allowed to be inserted into the through-hole can be considered. That is, it is believed that, as a size which does not allow fingers to easily insert into, the size of hole which does not allow a cylinder with 8 mm in diameter to insert into the through-hole is the best.

In order that a cover member is further compactly configured, it is desirable that the cover member includes a left-right cover member to move in the left-right direction in accordance with the movement of the seat and a front-rear cover member to move in the front-rear direction in accordance with the movement of the seat, and that the left-right cover member and the front-rear cover member are configured in combination and the through-holes are arranged on at least one of the cover members.

In order to effectively prevent an interference between cover members, it is desirable that the left-right cover member and the front-rear cover member relatively move close to each other with a gap. That is, when there is a gap, it is possible to prevent the cover members from interfering to each other, and further, when the gap is appropriately set, it is possible to effectively prevent foreign materials from being inserted between the cover members.

In order to effectively improve the appearance of a part of the chair which can be visually recognized through the through-holes or the cover members, it is desirable that the through-holes are arranged on at least two facing surfaces or the two adjoining surfaces of the cover member. That is, when the through-holes are arranged on facing surfaces or the adjoining two surfaces, especially, the light transmission properties are improved, and accordingly, high see-through feeling or light-weight feeling can be expected.

Especially, when the through-holes are arranged on the entire surfaces of the cover members, the see-through feeling or light-weight feeling can be obtained in the various angles.

In addition, the cover member according to the present invention configures the chair as described above. That is, the cover member described above is only prepared, the safety of the chair can be secured and the preferable appearance thereof can be effectively realized.

Effect of the Invention

The present invention described above provides the chair and the cover member of the chair that can avoid contact of a sitting person with a movement mechanism moving at below the seat at the time of movement of the seat or the backrest, and that include the cover which can appropriately maintain the appearance of the chair.

MODE FOR CARRYING OUT THE INVENTION

First Embodiment

Herein, a first embodiment of the present invention will be described with reference to the drawings.

Figure 1:
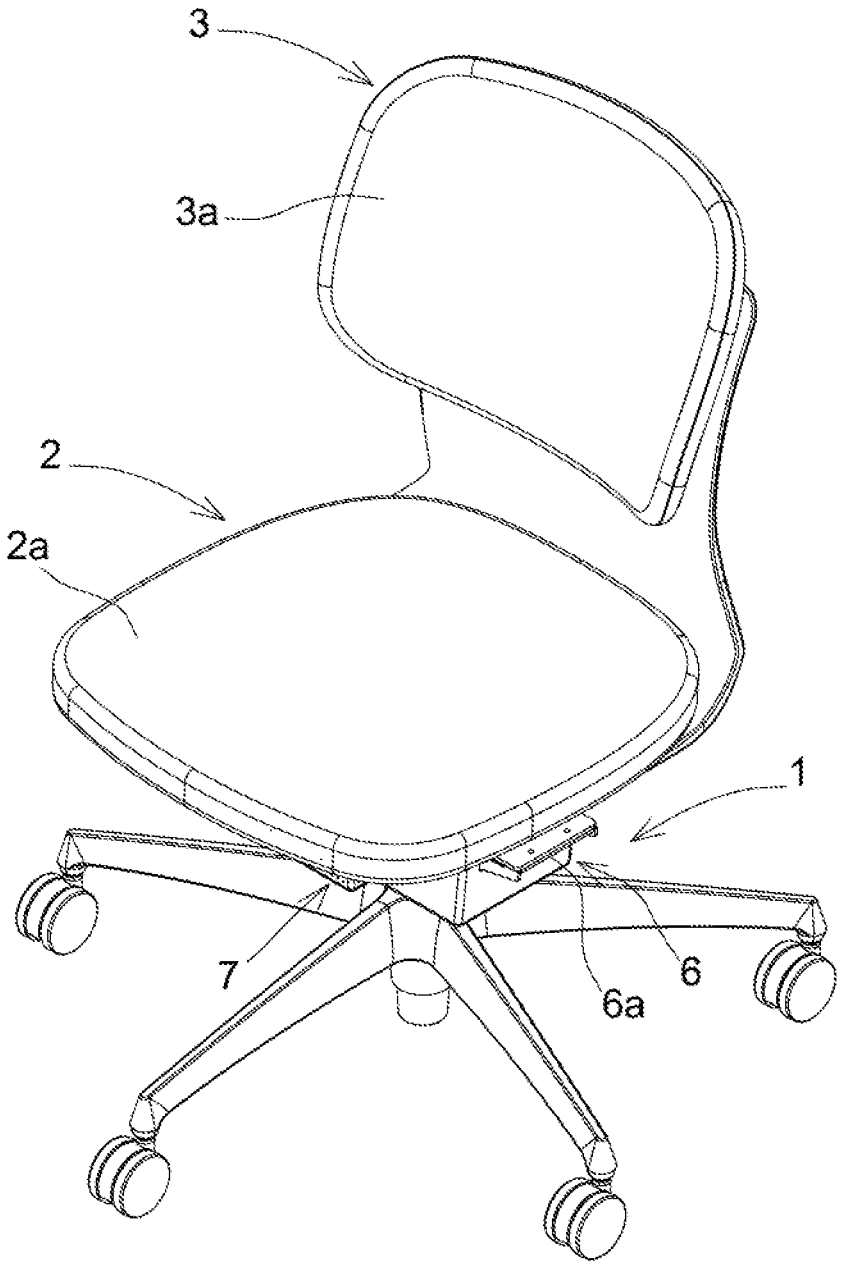
FIG. 1 is a perspective view of a chair according to a first embodiment of the present invention.
Figure 2:
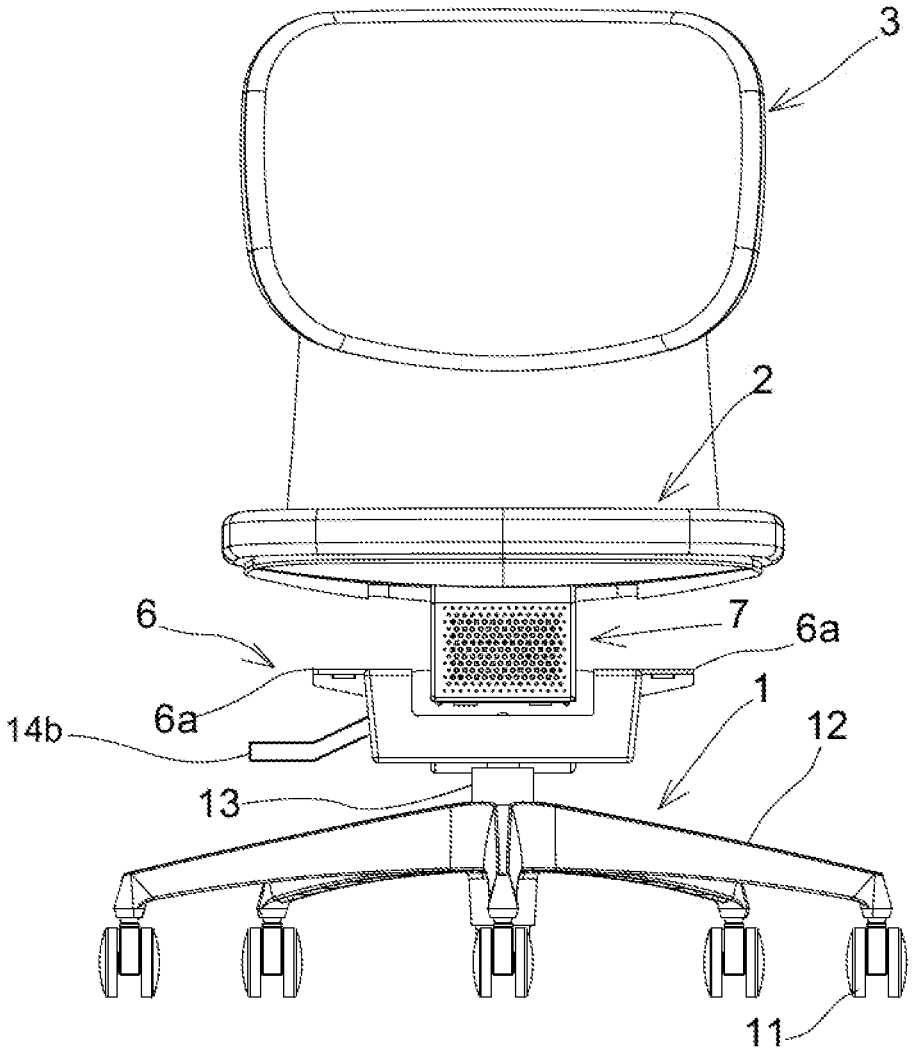
FIG. 2 is a front view of the chair according to the first embodiment of the present invention.
Figure 3:
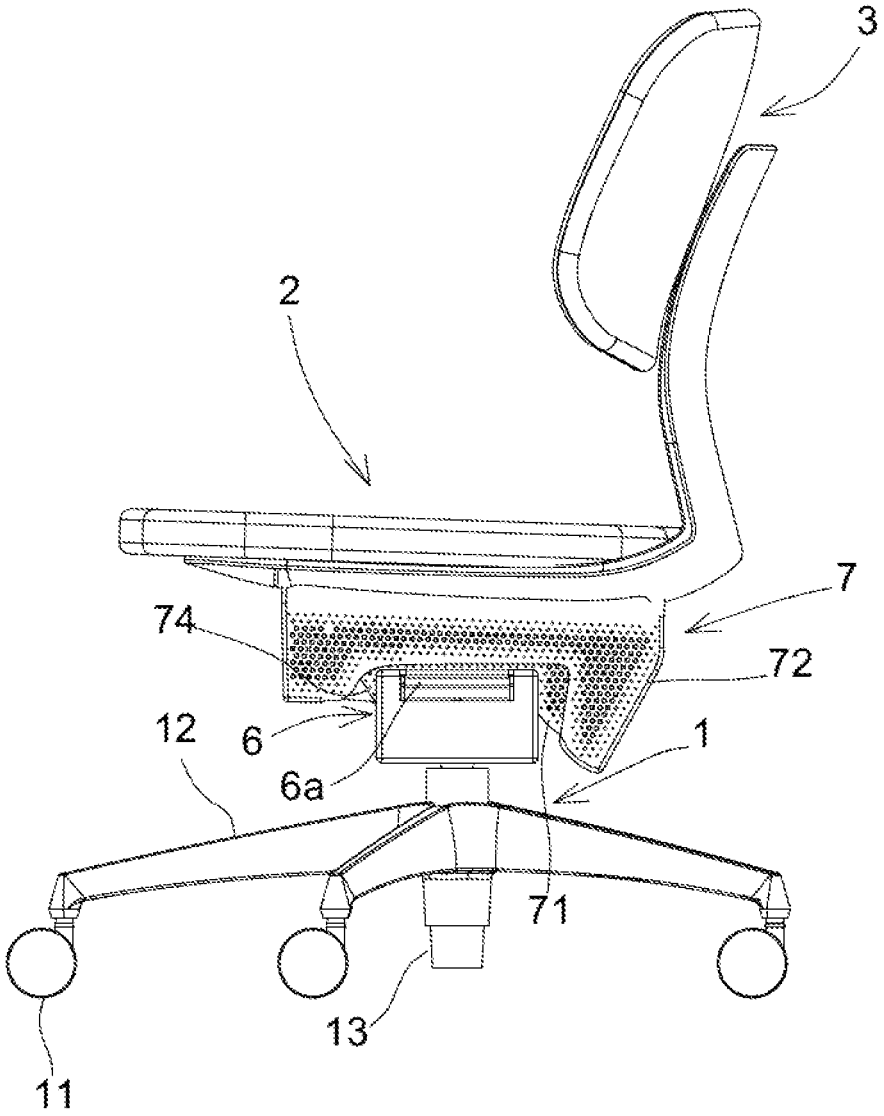
FIG. 3 is a right-side view of the chair according to the first embodiment of the present invention.
Figure 4:
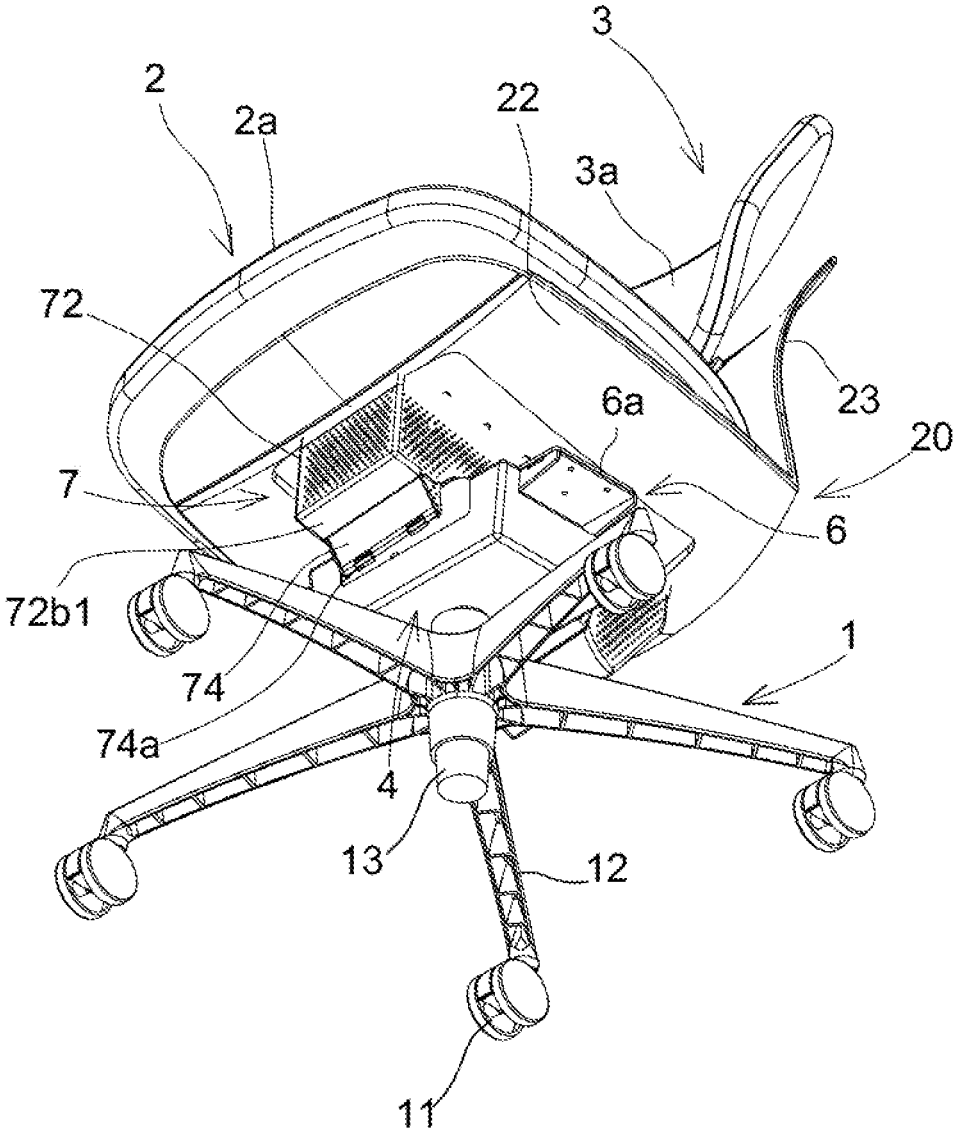
FIG. 4 is a lower perspective view of the chair according to the first embodiment of the present invention.
Figure 5:
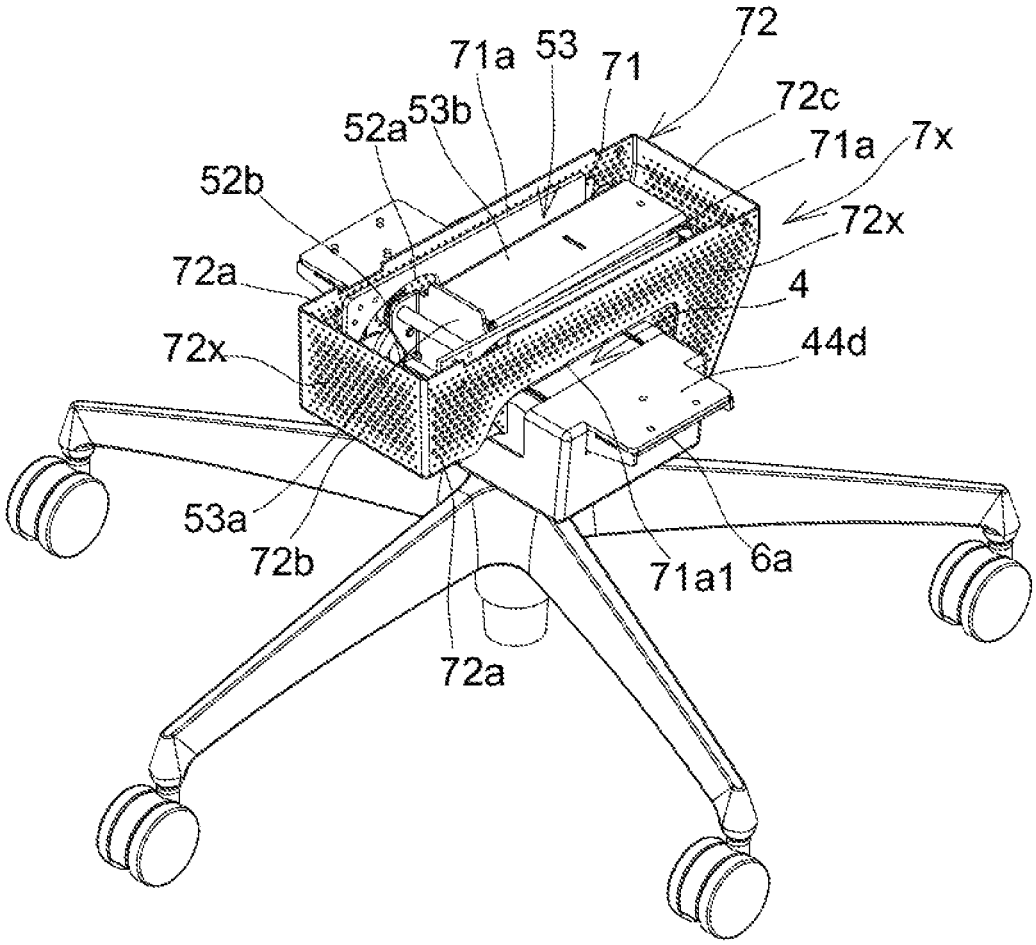
FIG. 5 is a perspective view illustrating a state of the chair according to the first embodiment of the present invention from which components located above a seat are removed.
Figure 6:
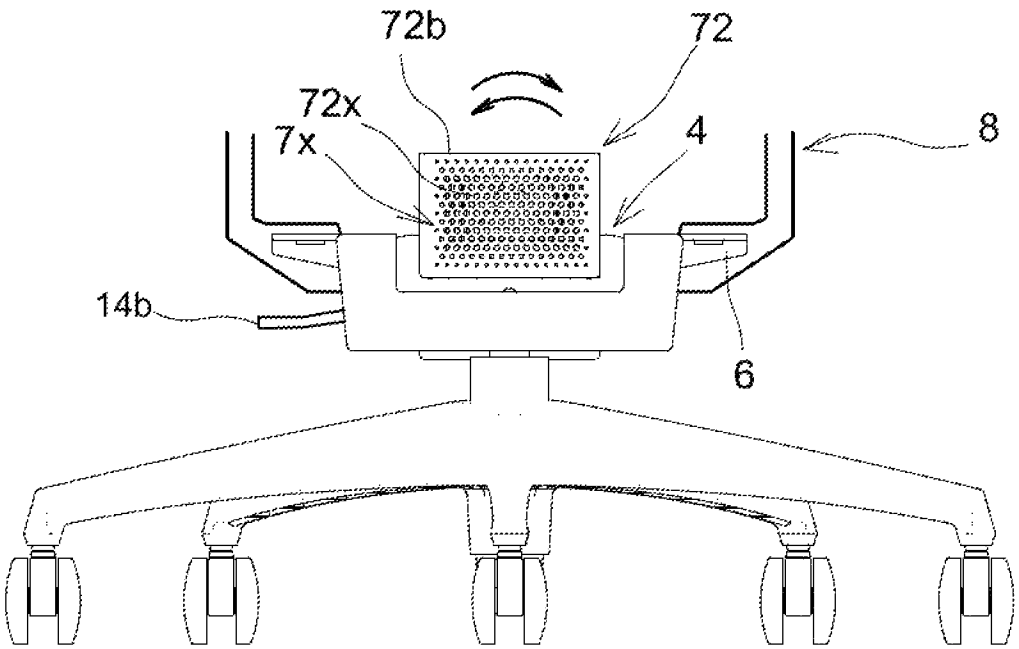
FIG. 6 is a front view illustrating a state of the chair according to the first embodiment of the present invention from which components located above a seat are removed.
Figure 7:
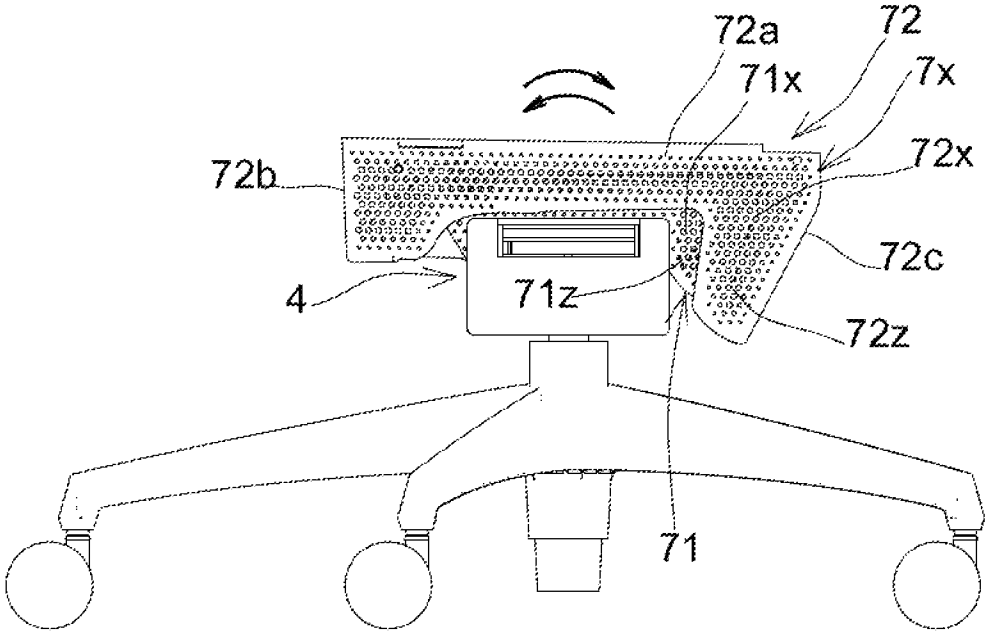
FIG. 7 is a right-side view illustrating a state of the chair according to the first embodiment of the present invention from which components located above a seat are removed.
Figure 8:
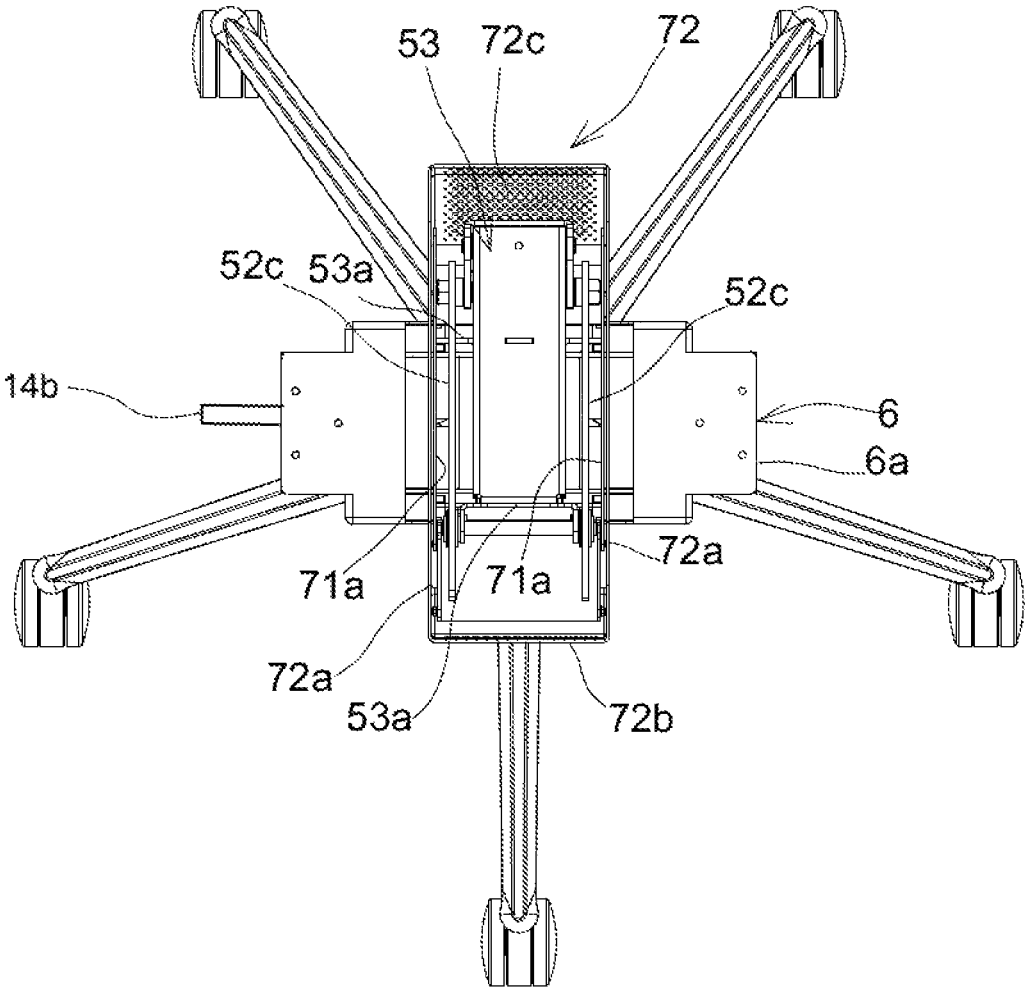
FIG. 8 is a plan view illustrating a state of the chair according to the first embodiment of the present invention from which components located above a seat are removed.
Figure 9:
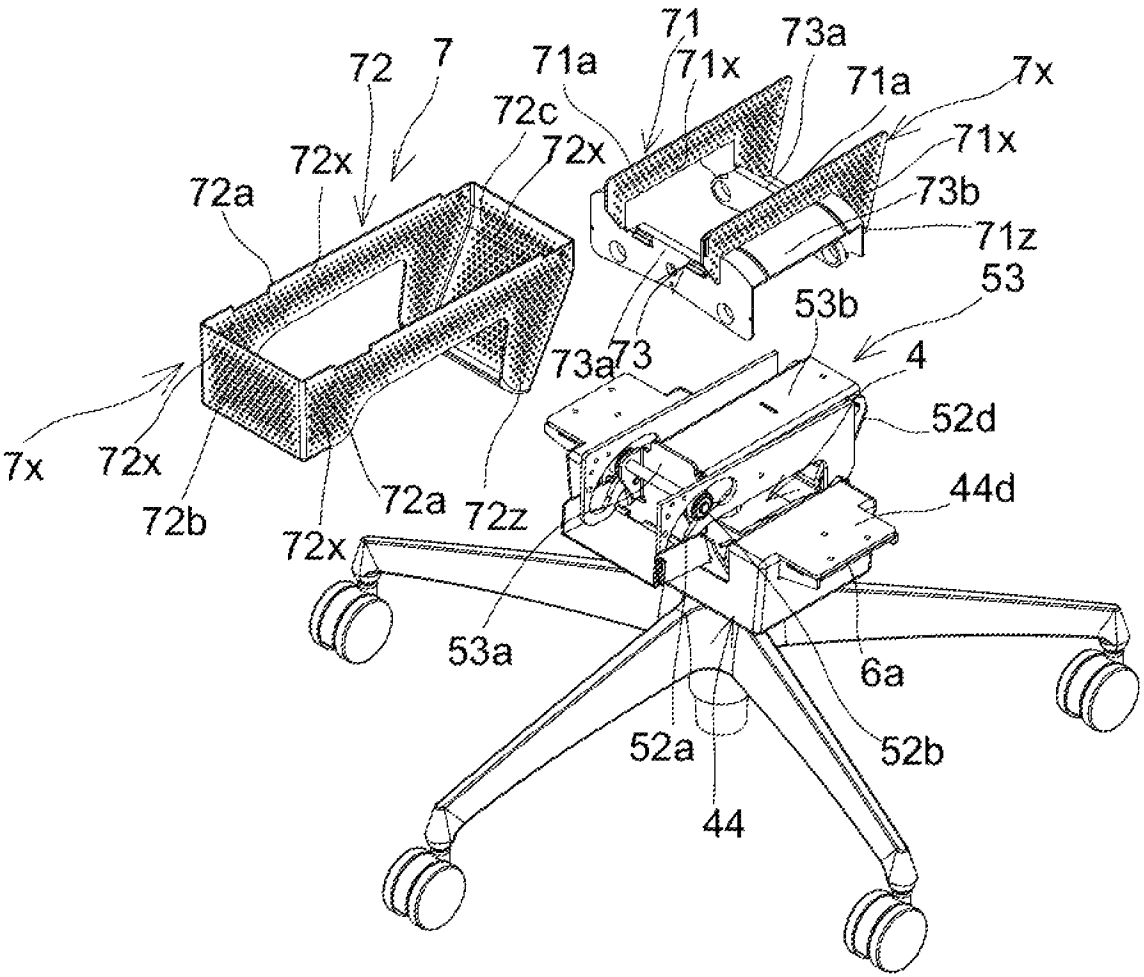
FIG. 9 is a partially exploded perspective view of FIG. 5.
Figure 10:
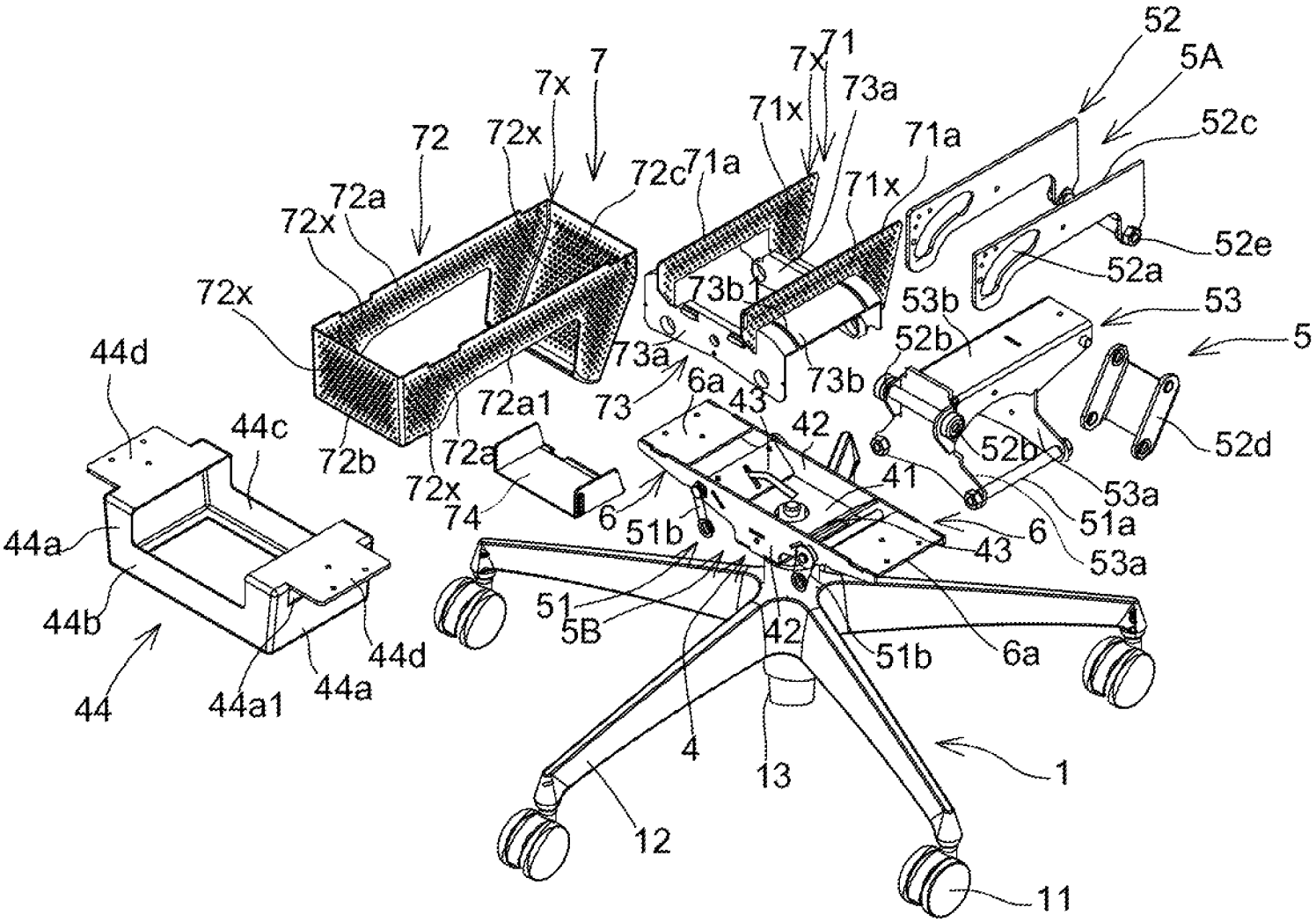
FIG. 10 is a further exploded perspective view of FIG. 9.
Figure 11:
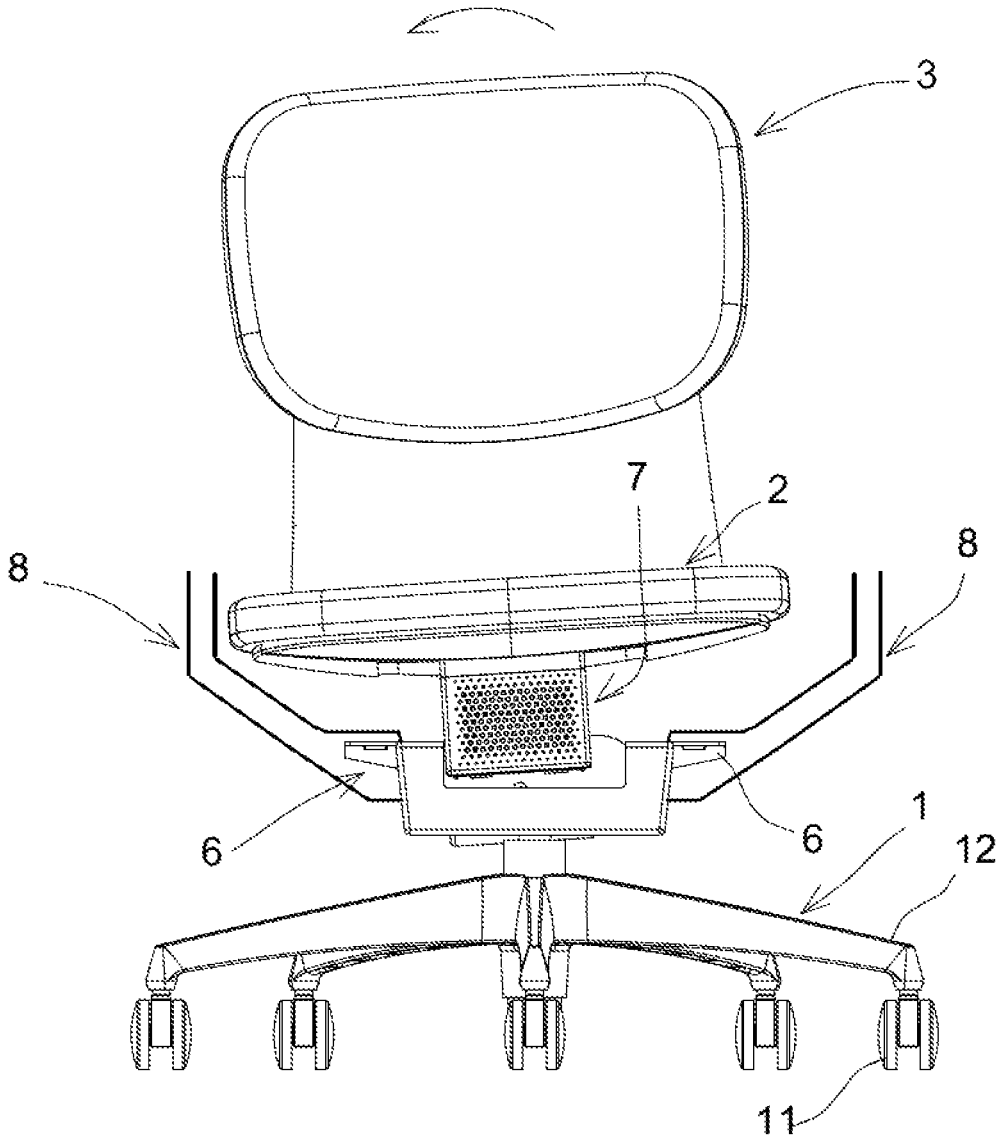
FIG. 11 is an explanatory diagram of movement according to the first embodiment of the present invention.
Figure 12:
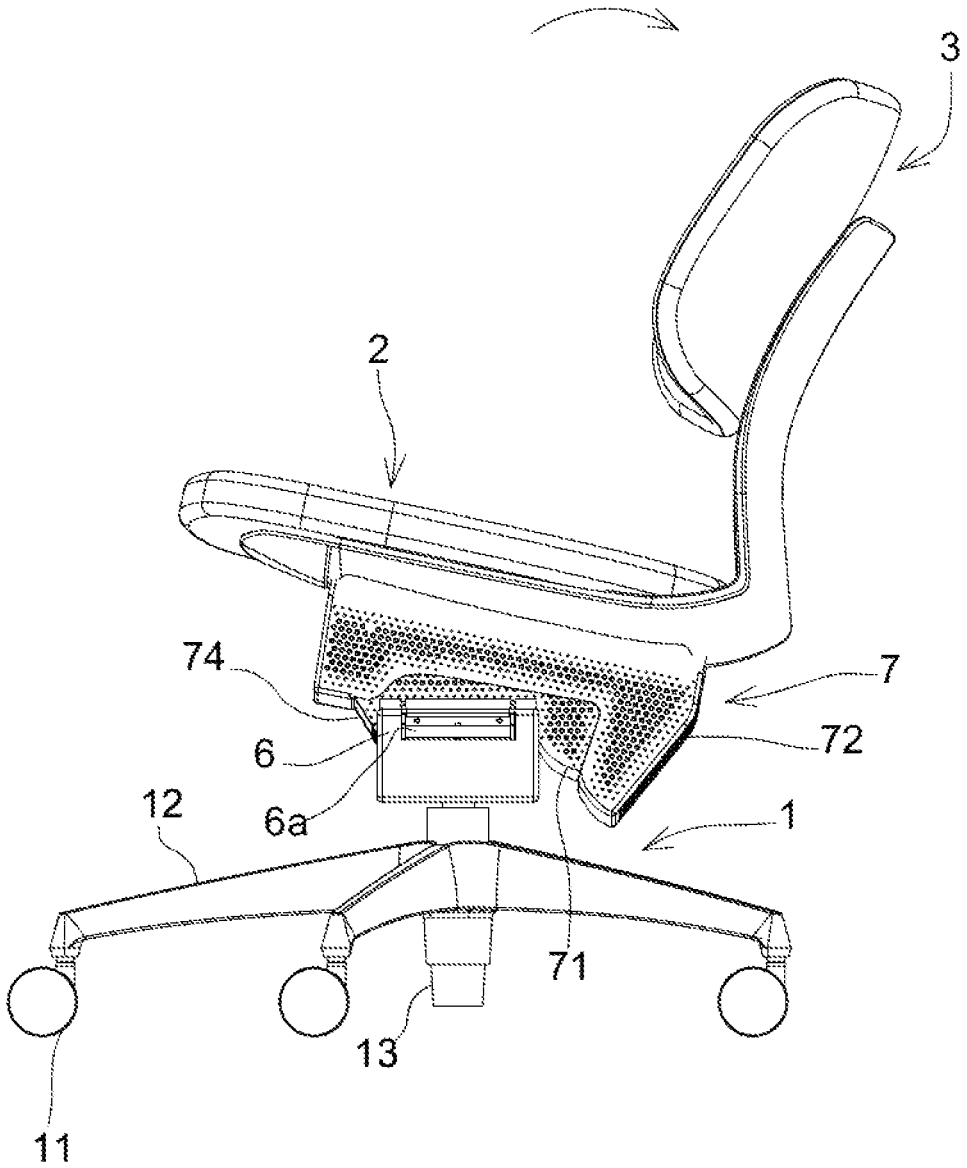
FIG. 12 is an explanatory diagram of movement according to the first embodiment of the present invention.

FIG. 1 is a perspective view of a chair according to the first embodiment. FIG. 2 is a front view of the chair according to the first embodiment. FIG. 3 is a right-side view of the chair according to the first embodiment. FIG. 4 is a lower perspective view of the chair according to the first embodiment. In addition, FIG. 5 is a perspective view illustrating a state of the chair according to the first embodiment from which components located above a seat are removed. FIG. 6 is a front view illustrating a state of the chair according to the first embodiment from which the components located above the seat are removed. FIG. 7 is a right-side view illustrating a state of the chair according to the first embodiment from which the components located above the seat are removed. FIG. 8 is a plan view illustrating a state of the chair according to the first embodiment from which the components located above the seat are removed. FIG. 9 is a partially exploded perspective view of FIG. 5. FIG. 10 is a further exploded perspective view of FIG. 9. FIGS. 11 and 12 are explanatory drawings each illustrating movement of the whole chair.

As illustrated in these drawings, the chair includes a leg 1 provided to stand from a floor surface, a seat 2 and a backrest 3 that are disposed above the leg 1, a leg support pole 13 attached to the leg 1 to support the seat 2 so that the seat 2 moves up or down and can rotate, a support base 4 fixed to an upper end of the leg support pole 13 and configured to horizontally rotate integrally with the leg support pole 13 and so as not to move in a front-rear and left-right directions in accordance with movement of the seat 2, a movement mechanism 5 interposed between the support base 4 and the seat 2 to support the seat 2 so that the seat 2 can move in the front-rear and left-right directions, an arm attachment part 6 supported by the support base 4, and a movable cover member 7 to cover the movement mechanism 5.

The seat 2 and the backrest 3 are integrally formed in the first embodiment. As illustrated in FIG. 4, a seat component 2*a* is attached to a seat corresponding portion 22 of an integral seat backrest outer shell 20, and a backrest component 3*a* is attached to a backrest corresponding portion 23 of the integral seat backrest outer shell 20. Even if the chair has a synchronized seat and backrest locking structure such that the seat 2 moves in the same direction in conjunction with the backrest 3 at a constant rate in accordance with the forward or backward tilting movement of the backrest 3, a support mechanism 5 of the first embodiment is obviously applicable to support the seat 2.

The leg 1 includes a leg blade 12 supported by casters 11, and the leg support pole 13 is fitted into a center hole of the leg blade 12. The leg support pole 13 is configured such that an upper support pole is rotatable relative to a lower outer cylinder. The support base 4 is attached to the rotatable upper support pole as illustrated in FIG. 10 or other drawings. The leg support pole 13 is a gas spring 14 that is a lifting mechanism body configuring a lifting mechanism. An operation end 14*a* of the gas spring 14 is arranged at an end position of the gas spring 14 penetrating through the support base 4.

The support base 4 is formed of a strengthening member integrally provided with a bottom wall 41, a pair of front-rear walls 42, and a pair of side walls 43 to form a ship shape. The bottom wall 41 is attached to the leg support pole.

The movement mechanism 5 supports the seat 2 and the backrest 3 so that each of the seat 2 and the backrest 3 moves in a certain area along a predetermined trajectory in plural directions. Specifically, the movement mechanism 5 includes a front-rear movement part 5A allowing a front-rear movement of the seat and the backrest and a left-right movement part 5B allowing a left-right movement of the seat and the backrest. The movement mechanism 5 not only moves the seat 2 and the backrest 3, but also functions as the support mechanism to support a load while moving the seat 2 in the front-rear and left-right directions. Herein, the movement mechanism 5 will be also referred to as the support mechanism 5 as required.

The support mechanism 5 includes a left-right support part 51 supporting the seat 2 movably in the left-right direction, and a front-rear support part 52 supporting the seat 2 movably in the front-rear direction.

The left-right support part 51 is configured such that left-right support portions as supported members, i.e., a pair of shafts 51*a*, are supported thought a link members 51*b* as left-right support members to suspend and support downward from the support base 4 as a support member. The pair of shafts 51*a* is supported to be swingable in the left-right direction. The shafts 51*a* are arranged below the support base 4. That is, the pair of shafts 51*a* as the left-right support portions is connected to the link members 51*b* to move in conjunction with the link members 51*b* as the left-right support members.

The front-rear support part 52 is attached though a connection member 53 to the pair of shafts 51*a* as the left-right support portions. The connection member 53 includes a pair of front and back brackets 53*a* to which the pair of shafts 51*a* is attached, and a swingable body 53*b* attached above the brackets 53*a* to hang over the support base 4 and formed in a box shape opening downward. In addition, front end portions of seat support walls 52*c* as front-rear support portions are supported on a front end portion of the swingable body 53*b* though cam surfaces 52*a* and cam followers 52*b*, both of which are front-rear support members. Rear end portions of the seat support walls 52*c* as the front-rear support portions are supported on a rear end portion of the swingable body 53*b* though a link member 52*d* as a front-rear support member. That is, the seat support walls 52*c* as the front-rear support portions are arranged above the support base 4. Further, in the first embodiment, as an example that the cam followers 52*b* are indirectly provided on the swingable body 53*b*, a mode that upper ends of the front bracket 53*a* of a sheet metal material fixed to the front end portion of the swingable body 53*b* are bent forward and the cam followers 52*b* are pivotally attached to the bent portions, is applied. That is, the seat support walls 52*c* as the front-rear support portions are connected to move in conjunction with the cam surfaces 52*a*, the cam followers 52*b*, and the link member 52*d*, all of which are the front-rear support members.

In addition, the seat 2 is attached to upper ends of the seat support walls 52*c*.

Each of the link members 51*b* of the left-right support part 51 is formed in a shape expanding from a reference position toward the upper side. Therefore, inside a cover member 72 described below based on FIG. 6, is configured to downwardly incline a tip side in a movement direction of the link member 51*b* as indicated by arrows in FIG. 6 in accordance with swinging of the shafts 51*a* as the left-right support portions from the reference position. In addition, as being dislocated from the reference position, the link members 51*b* move such that a center position between the shafts 51*a*, 51*a* is elevated.

Furthermore, the seat support walls 52*c* being the front-rear support portions is set so that the front end portion is supported at an intermediate position of the cam surface 52*a* inclining forward and downward from a reference position, by the cam follower 52*b* and the rear end portion is supported by the link member 52*d* hanging forward and downward from a reference position. Accordingly, inside the front-rear cover member 72 described below based on FIG. 7, when the seat support wall 52*c* as the front-rear support portion moves forward from the reference position, the front end thereof is moved downward, and the rear end thereof is moved upward. Meanwhile, when the seat support wall 52*c* moves rearward, the front end thereof is moved upward and the rear end thereof is moved downward, and in addition, as being dislocated from the reference position, the seat support wall 52*c* moves such that a center position of the seat support wall 52*c* is elevated.

As a result, the seat 2 can move in the left-right direction while moving in the front-rear direction, and a moving tip side of the seat 2 inclines downward, as being dislocated from a reference position, the seat 2 is supported such that a center position of the seat 2 is elevated.

The arm attachment parts 6 are integrally provided on the support base 4 and ends 6*a* of the respective arm attachment parts 6 are located at positions laterally extended from the support base 4 to the right side and the left side.

Specifically, the front-rear support part 52 is located above an upper portion of the support base 4 attached to an upper portion of the leg support pole 13, and the left-right support part 51 is disposed below the upper portion of the support base 4. Therefore, a space for extending the arm attachment parts 6 exists between the front-rear support part 52 and the left-right support part 51. Consequently, the arm attachment parts 6 can be formed in a manner to be laterally extended without interfering with the front-rear support part 52 and the left-right support part 51.

More specifically, the link members 51*b* as a pair of right and left support members are pivotally attached to the support base 4 to suspend therefrom. The cam surfaces 52*a* and the cam followers 52*b*, which are a pair of front and back support members, are arranged though the bracket 53*a* from the shafts 51*a* as the left-right support portions supported by the link members 51*b*, and a link shaft 52*e* is arranged though the bracket 53*a* from the shafts 51*a*. Further, the seat support walls 52*c* as the front-rear support portions are attached to the cam surfaces 52*a*, the cam followers 52*b* and the link member 52*d*. Furthermore, the seat 2 is attached to the seat support walls 52*c*. That is, the link members 51*b* are provided to suspend from the support base 4 and thereby the shafts 51*a* as the left-right support portions located at lower ends of the link members 51*b* are arranged below the support base 4 and located separately from each other. In addition, the seat support walls 52*c* substantially horizontally shift while swinging when being moved in the front-rear direction by the cam surfaces 52*a*, the cam followers 52*b* and the link member 52*d*, and thus do not largely move up and down. Therefore, a space for extending the arm attachment parts 6 and an attachment place for attaching the seat 2 are appropriately secured.

A fixation cover 44 is attached to the support base 4. The fixation cover 44 is integrally provided in a frame shape in planar view with right and left side fixation walls 44*a*, a front fixation wall 44*b*, and a back fixation wall 44*c*, and arm fixation portions 44*d* are integrally provided to laterally extend between an intersection between each of the side fixation walls 44*a* and the front fixation wall 44*b* and an intersection between each of the side fixation walls 44*a* and the back fixation wall 44*c*. Various specific attachment procedures may be taken. The support base 4 is arranged in the frame-shaped space of the fixation cover 44, and the arm attachment parts 6 are arranged to be laterally extend through openings 44*al* formed in the respective side walls 44*a* of the fixation cover 44 in with lower portions of the respective arm fixation portions 44*d*.

Further, an operation lever 14*b* illustrated in FIG. 2 and configured to operate the operation end 14*a* of the gas spring 14 is disposed on a lower surface of one of the arm fixation portions 44*d*.

Furthermore, as illustrated in FIG. 6 and FIG. 11, arms 8 are detachably attached to the arm attachment parts 6. In addition, each of the arms 8 is fixed to the arm attachment part 6 from the lower or lateral side of the arm attachment part 6 by a fastening member such as a bolt.

On the other hand, as illustrated in FIG. 10, the movable cover member 7 includes a left-right cover member 71 attached to the left-right support part 51, a front-rear cover member 72 attached to the front-rear support part 52, and an interpolation cover member 74 interposed between the left-right cover member 71 and the front-rear cover member 72. The front-rear cover member 72, the left-right cover member 71, and the interpolation cover member 74 are configured in combination, therefore configuring the cover member 7. In addition, in accordance with movements of the plural movement parts 5A, 5B, the cover members 72, 71 move relatively in different directions in a certain area along a predetermined trajectory.

Specifically, the left-right cover member 71 includes a pair of right and left standing walls 71*a* each formed in a substantially L-shape. The left-right cover member 71 is attached to a cover attachment member 73. The cover attachment member 73 includes a pair of front and back support plates 73*a* and a cover plate 73*b* connecting between the support plates 73*a*, 73*a*. The support plate 73*a* is swingable attached to swing ends of the respective link members 51*b* together with the shafts 51*a* as the left-right support portions. In such an attaching state, the seat support walls 52*c* as the front-rear support portions are arranged inside the front-rear cover member 72, and the seat support walls 52*c* swing in the left-right direction together with the front-rear cover member 72.

In addition, as illustrated in FIG. 11, in accordance with the left-right swinging of the seat support walls 52*c*, the seat 2 fixed to the seat support walls 52*c* swings in the left-right direction together with the backrest 3. FIG. 11 illustrates an operation in which the seat 2 swings to the left side of FIG. 11. Likewise, obviously, the seat 2 may swing to the right of FIG. 11.

Here, the arms 8 detachably attached to the arm attachment parts 6 provided on the support base 4 do not move in accordance with the swinging of the seat 2. In addition, each of the arms 8 is shaped not to make contact with the seat 2 even at a swing end of the seat 2 in the left-right direction.

Meanwhile, the front-rear cover member 72 is configured such that right and left standing side walls 72*a*, a front wall 72*b*, and a back wall 72*c* tilted rearward are connected in a frame shape in planar view. The front-rear cover member 72 includes a space inside thereof in which the left-right cover member 71 can be housed. The front-rear cover member 72 is attached to the seat support walls 52*c* as the front-rear support portions, and configure so that while the front-rear cover member 72 swings together with the seat support walls 52*c* in the left-right direction and the front-rear direction, the cam surfaces 52*a* and the cam followers 52*b*, both of which are the front-rear support members, are covered and hidden by the side walls 72*a* and the front wall 72*b*, and the link member 52*d* as the front-rear support member is covered and hidden by the side walls 72*a* and the back wall 72*c*. Therefore, each of the side walls 72*a* is formed in a reversed L-shape. In addition, as illustrated in FIG. 4, a front bottom wall 72*b*1 substantially horizontally disposed is provided at a lower end portion of the front wall 72*b*. The front bottom wall 72*b*1 is consistently contactable with a portion of the interpolation cover member 74.

Meanwhile, the interpolation cover member 74 is interposed between the left-right cover member 71 and the front-rear cover member 72. Specifically, the interpolation cover member 74 is rotatably engaged though a shaft 74*a* with an upper end on the front side of the cover attachment member 73, therefore being rotatably attached in the front-rear direction.

A space in which an opening between the facing side walls 71*a*, 71*a* of the left-right cover member 71 is communicated with an opening between the facing side walls 72*a*, 72*a* of the front-rear cover member 72 corresponds to a space in which the foregoing connection member 53 to connect the left-right support part 51 to the front-rear support part 52 is arranged.

As illustrated in FIGS. 5 and 8, each of the side walls 72*a* of the front-rear cover member 72 is located adjacent to each of the side walls 71*a* of the left-right cover member 71; however, the front-rear cover member 72 swings together with the left-right cover member 71 in the left-right direction and therefore a gap between the side wall 72*a* and the side wall 71*a* is maintained. Meanwhile, the left-right cover member 71 does not swing in the front-rear direction, and the front-rear cover member 72 swings in the front-rear direction. Therefore, gaps are provided between the front wall 72*b* of the front-rear cover member 72 and front ends of the respective side walls 71*a* of the left-right cover member 71 and between the back wall 72*c* of the front-rear cover member 72 and rear ends of the respective side walls 71*a* of the left-right cover member 71 such that the relative movement does not cause interference therebetween.

Thus, the cover member 7 is configured such that the left-right cover member 71 and the front-rear cover member 72 move relatively close to each other with the gap.

As just described, the cover members 71, 72 moves following in accordance with the movement of the seat 2, and in addition, can cover the support mechanism 5. That is, for the left-right movement of the seat 2, the cover members 71, 72 cover the support mechanism 5 while swinging in the left-right direction, as indicated by arrows in FIG. 6, in accordance with the left-right swinging of the left-right support part 51 configuring the support mechanism 5. In this case, recessed portions 72a1 are formed at lower portions of the respective side walls 72a of the front-rear cover member 72; therefore, even when swinging in the left-right direction, the front-rear cover member 72 is prevented from interfering with components of the support base 4. Also, as illustrated in FIG. 10, slits 73b1 are provided in the cover plate 73b of the cover attachment member 73 to which the left-right cover member 71 is attached. At the time of swinging, the front and back walls 42 of the support base 4 are received in the slits 73b1. Therefore, even when the cover attachment member 73 is arranged closely to the support base 4, an interference between the cover attachment member 73 and the support base 4 is avoided, and in addition, the role of a gap insertion plate to close a gap consistently inserted in the gap between the support base 4 and the left-right support part 52 is played.

Here, as illustrated in FIG. 12, the seat support walls 52c as the front-rear support portions are connected to move in conjunction with the cam surfaces 52a, the cam followers 52b, and the link member 52d, all of which are the front-rear support members. Therefore, the seat 2 fixed to the seat support walls 52c swings in the front-rear direction. FIG. 12 illustrates the swinging of the seat 2 to the back side, i.e., the swinging of the seat 2 to the right side of FIG. 12. Obviously, the seat 2 is swingable further forward than a state illustrated in FIG. 3.

For the front-rear movement of the seat 2 as above, in the same way as illustrated in FIG. 7, the front-rear cover member 72 swings in the front-rear direction in accordance with the front-rear swinging of the front-rear support part 52 configuring the support mechanism 5, but the left-right support part 51 does not swing in the front-rear direction. Therefore, a downward protrusion portion 71z forming the reversed L-shape of each of the side walls 71a of the left-right cover member 71 and a downward protrusion portion 72z forming the reversed L-shape of each of the side walls 72a of the front-rear cover member 72 cover together a movement range of the link member 52d to hide the movement range. In addition, the left-right cover member 71 closes a gap between each of the recessed portions 72a1 of the front-rear cover member 72 and the support base 4.

Consequently, even when the cover members 71, 72 execute a complex movement to each other, foreign objects are prevented from being trapped between the cover members 71, 72 or between the support base 4 and the cover members 71, 72.

On the other hand, at the time of the front-rear swinging of the seat 2 as illustrated in FIG. 12, the arms 8 detachably attached to the respective arm attachment parts 6 provided on the support base 4 do not move in accordance with the swinging of the seat 2. Further, as illustrated in FIG. 11, even at a swing movement end of the seat 2 in the left-right direction, each of the arms 8 does not make contact with the seat 2.

Furthermore, at the time of the front-rear movement of the seat 2, inside the front-rear cover member 72, the interpolation cover member 74 rotatably attached to a front end of the cover attachment member 73 rotates around the shaft 74a with respect to the left-right cover member. In other words, the interpolation cover member 74 rotates around the shaft 74a at a base end side with contacting to the front bottom wall 72b1 of the front-rear cover member 72 with leaning on the front bottom wall 72b1 at a tip end. Thus, generation of a gap between a front end portion of the left-right cover member 71 and the front-rear cover member 72 is effectively avoided.

Also, in the first embodiment, through-holes 7x each including a round hole are formed in any of the cover members 71, 72. The through-hole 7x includes through-holes 71x, 72x formed in the both cover members 71, 72 respectively in the first embodiment. The plural through-holes 71x, 72x are arranged lengthwise and breadthwise at equal intervals, moreover, at substantially equal pitches in the front-rear direction and the left-right direction entirely in respective surfaces. The hole diameter is designed to be small at a location adjacent to a rim of the cover member. Further, the through-holes 71x, 72x are arranged on the surfaces surrounding the movement mechanism 5 such that when one of the through-holes 71x, 72x is viewed from the outer surface side, other through-holes can be visually recognized from the inner surface side. In a location where the through-holes 71x, 72x are arranged on the two facing surfaces or the two adjoining surfaces of each of the cover members 71, 72, in particular, when one of the through-holes 71x, 72x is viewed from the outer surface side, other through-holes 71x, 72x is easily visually recognized from the inner surface side and thus light transmission properties are easily secured. Furthermore, since the through-holes 71x, 72x are arranged entirely in the standing surfaces, the light transmission properties are secured in any directions. The size and shape of the through-hole of the first embodiment is designed such that a cylinder with 8 mm in diameter is not allowed to insert into the through-hole. The aperture ratio of such through-holes 71x, 72x is preferably 10% or higher in each of the surfaces including the through-holes 71x, 72x, and is further preferably 15% or higher. It is to be noted that the shape of the through-hole 7x is not limited to a circle. Alternatively, through-holes of various shapes such as a slit-shaped through-hole or a cross-shaped through-hole may be applied as the through-hole 7x. Moreover, the through-holes 7x are arranged in the both cover members 71, 72, but not limited to such a configuration. Alternatively, the through-hole 7x may be arranged either one of the cover members (the cover member 71 or the cover member 72).

Second Embodiment

Hereinafter, a second embodiment of the present invention will be described with reference to the drawings. In the second embodiment, the same reference numbers are assigned to components corresponding to those of the foregoing first embodiment and detailed explanations of the components will be omitted.

Figure 13:
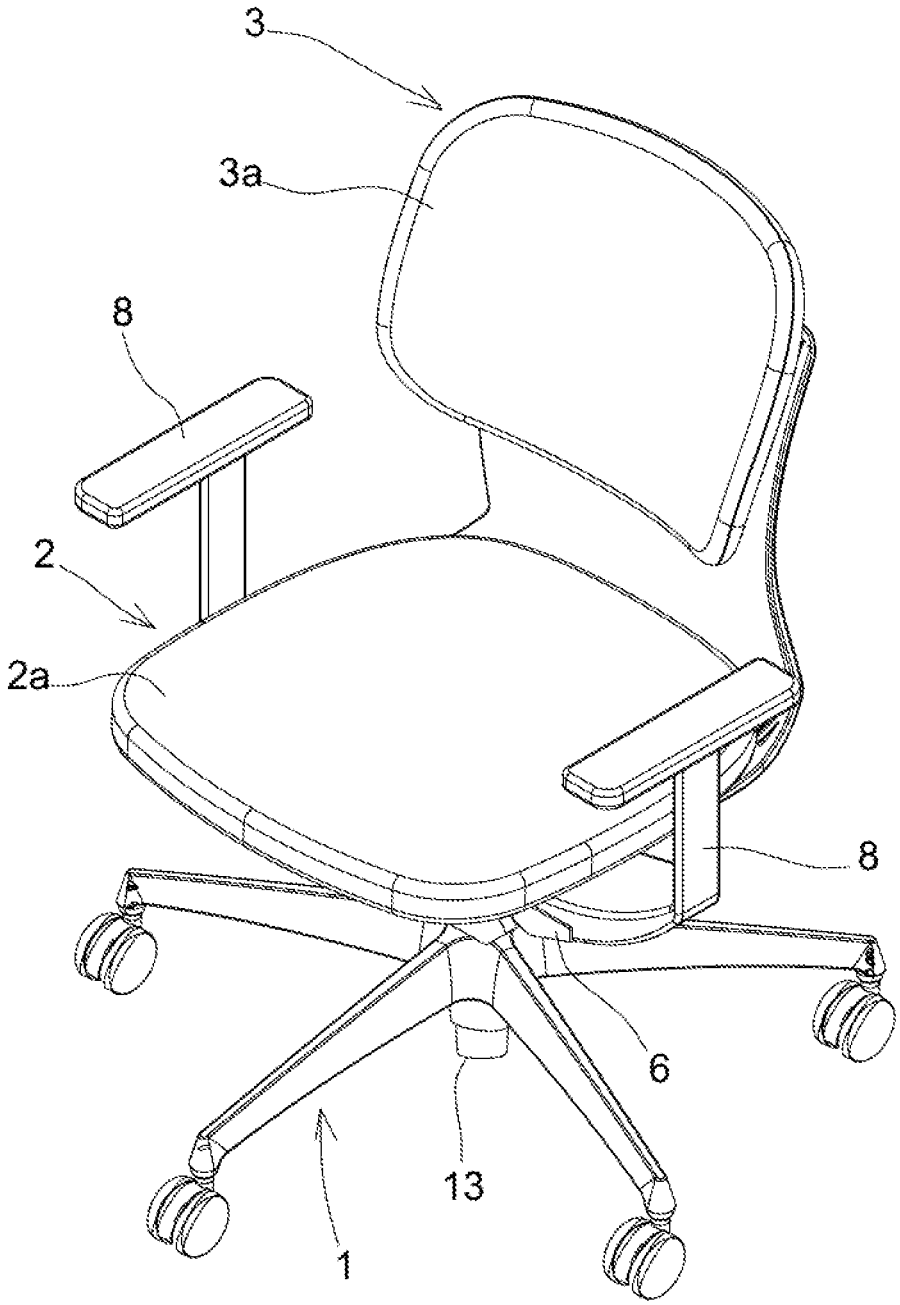
FIG. 13 is a perspective view of the chair according to a second embodiment of the present invention.
Figure 14:
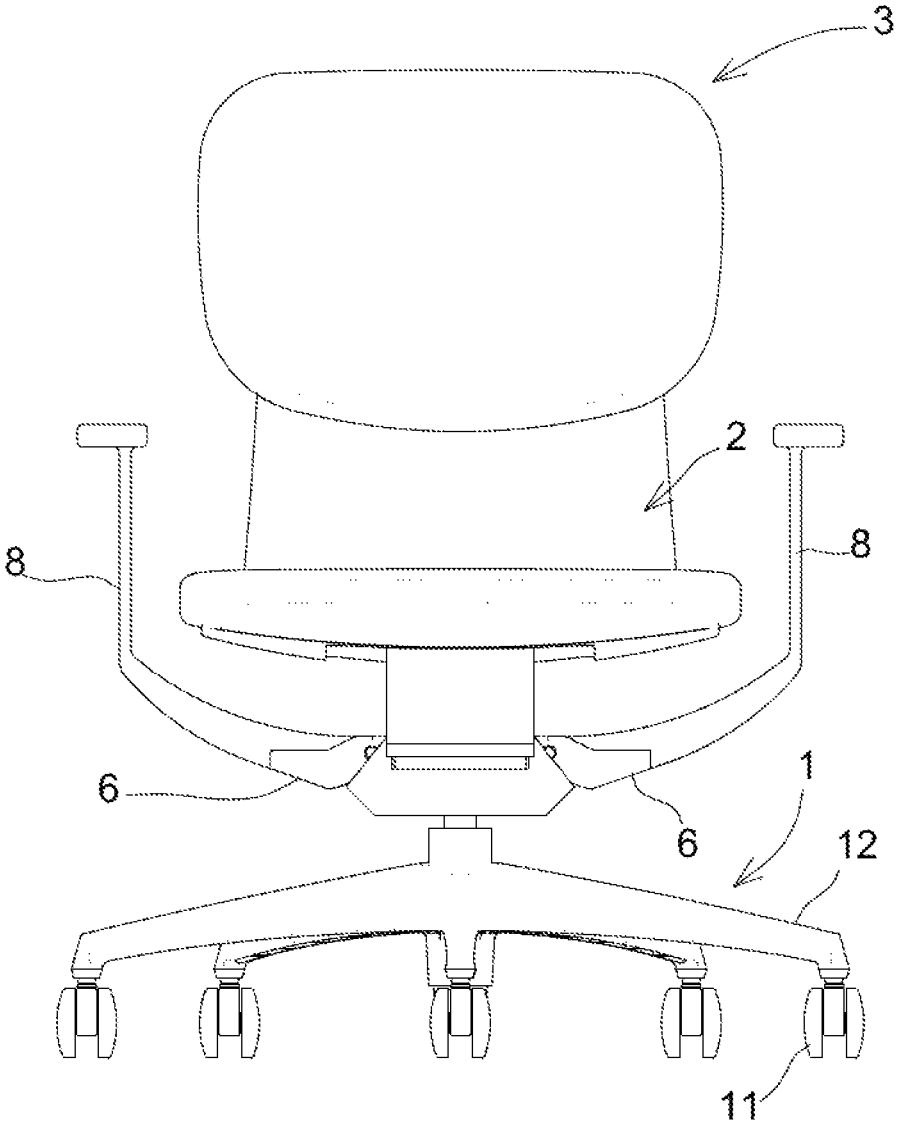
FIG. 14 is a front view of the chair according to the second embodiment of the present invention.
Figure 15:
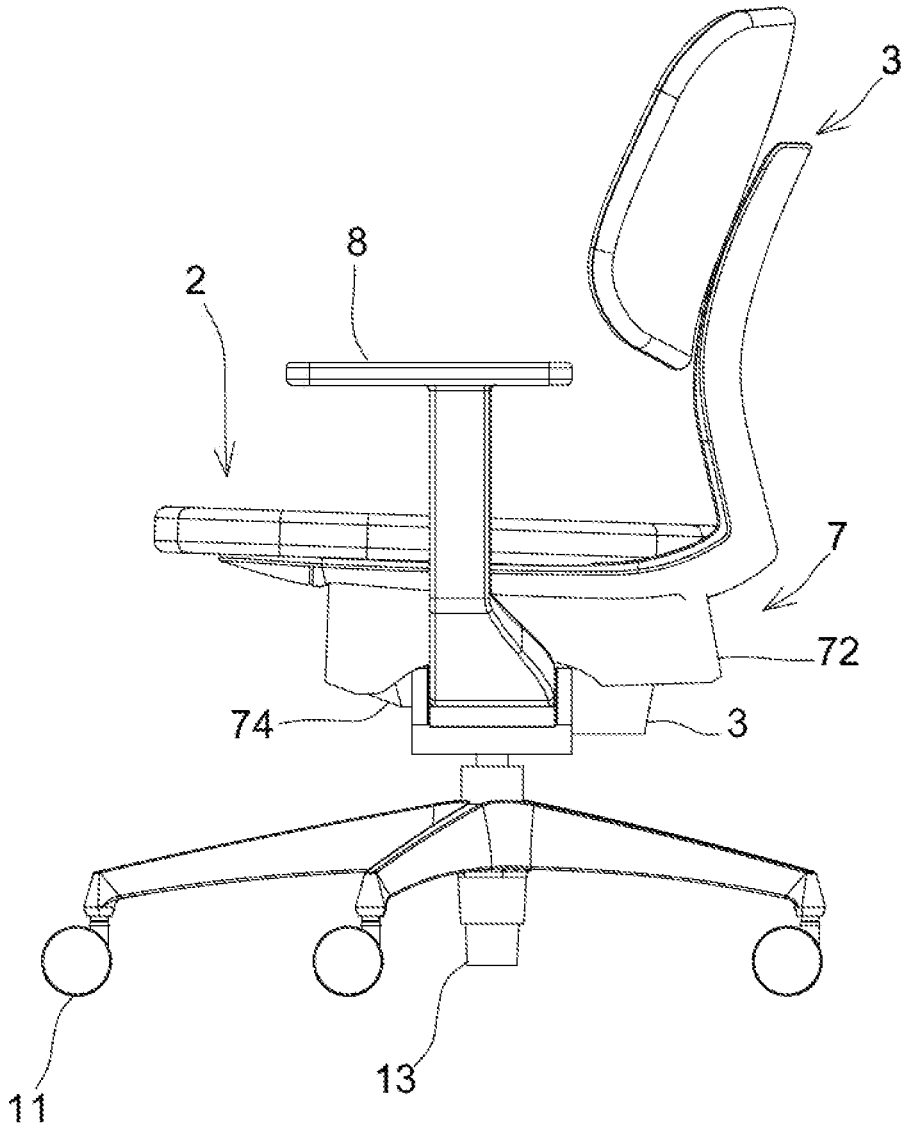
FIG. 15 is a right-side view of the chair according to the second embodiment of the present invention.
Figure 16:
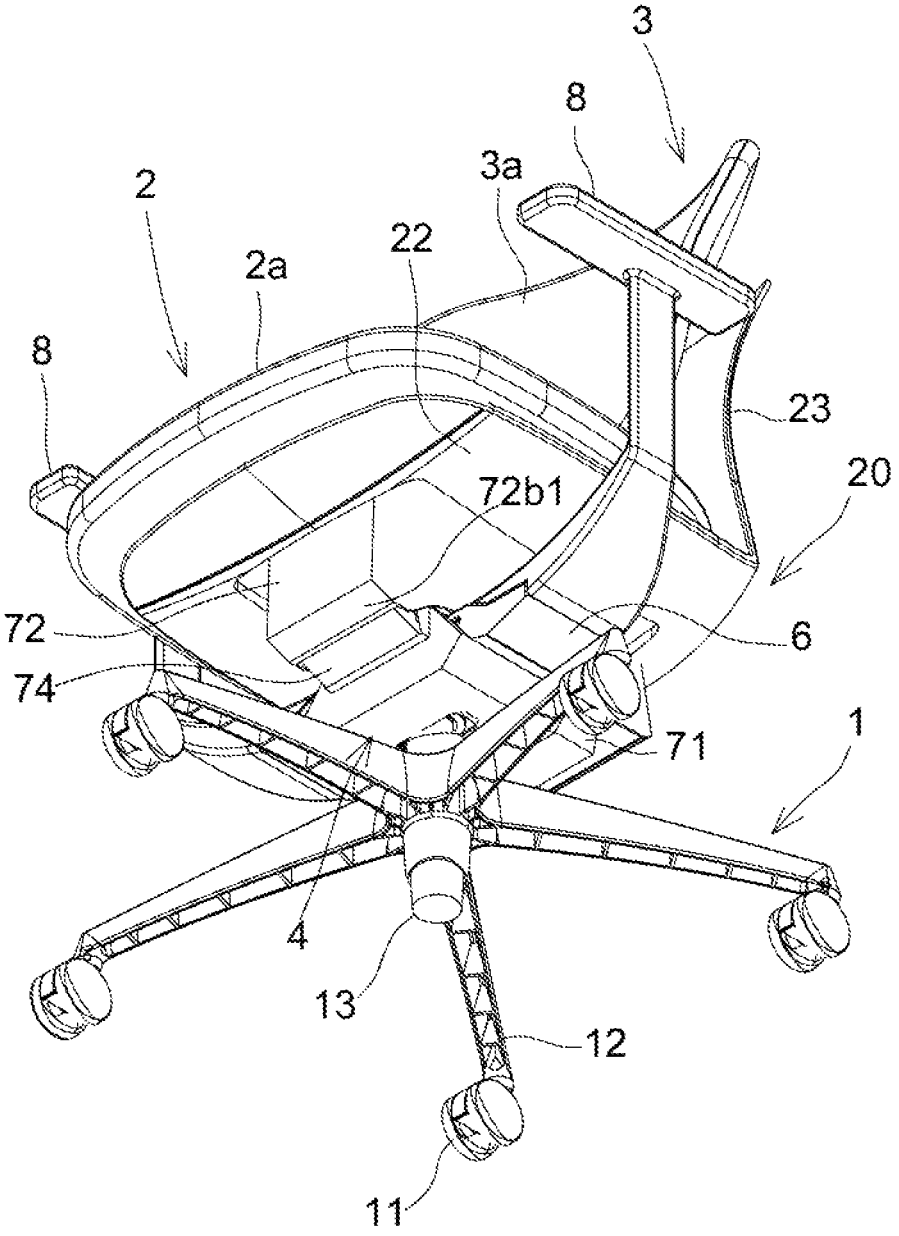
FIG. 16 is a lower perspective view of the chair according to the second embodiment of the present invention.
Figure 17:
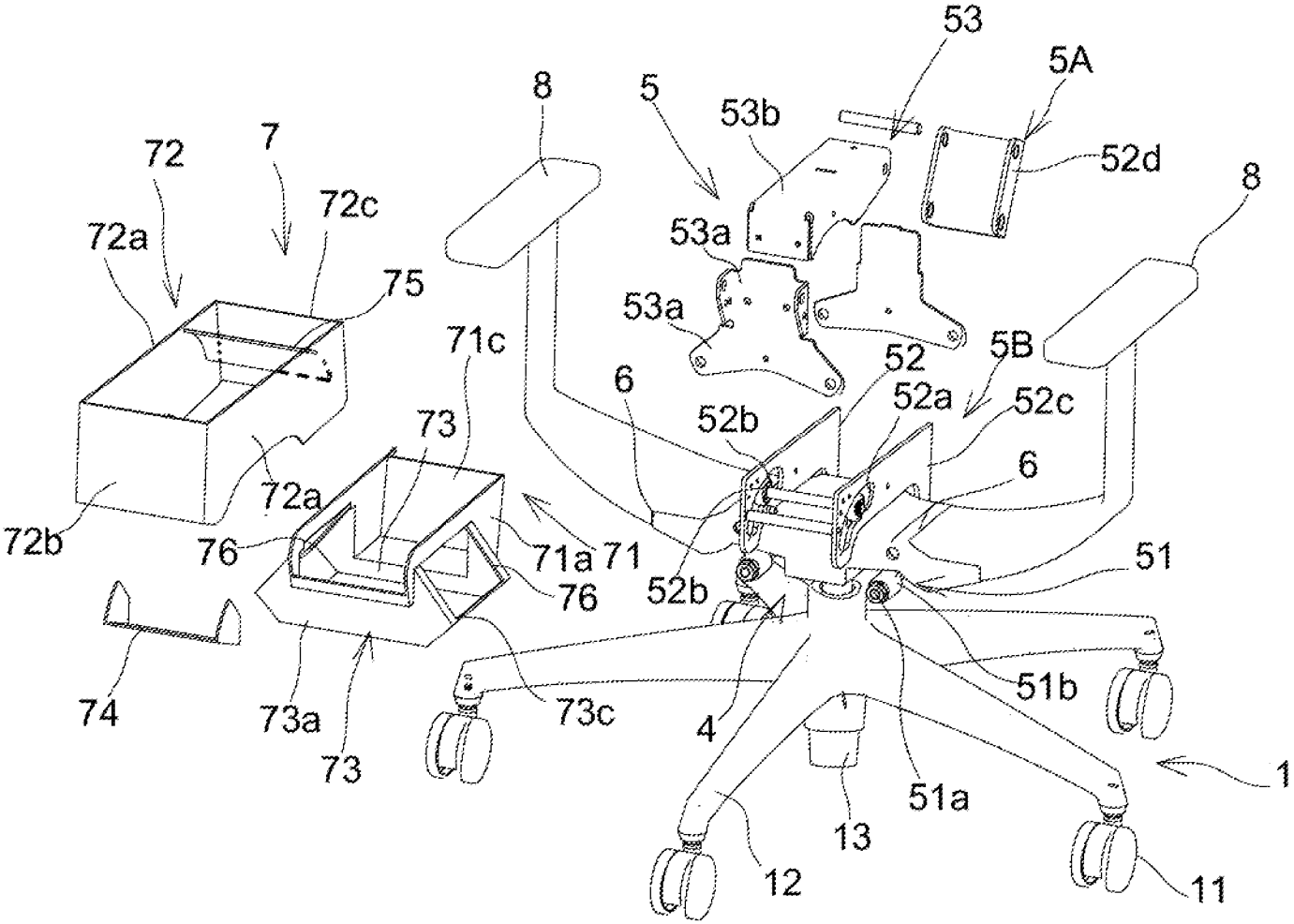
FIG. 17 is an exploded perspective view of major parts according to the second embodiment of the present invention.
Figure 18:
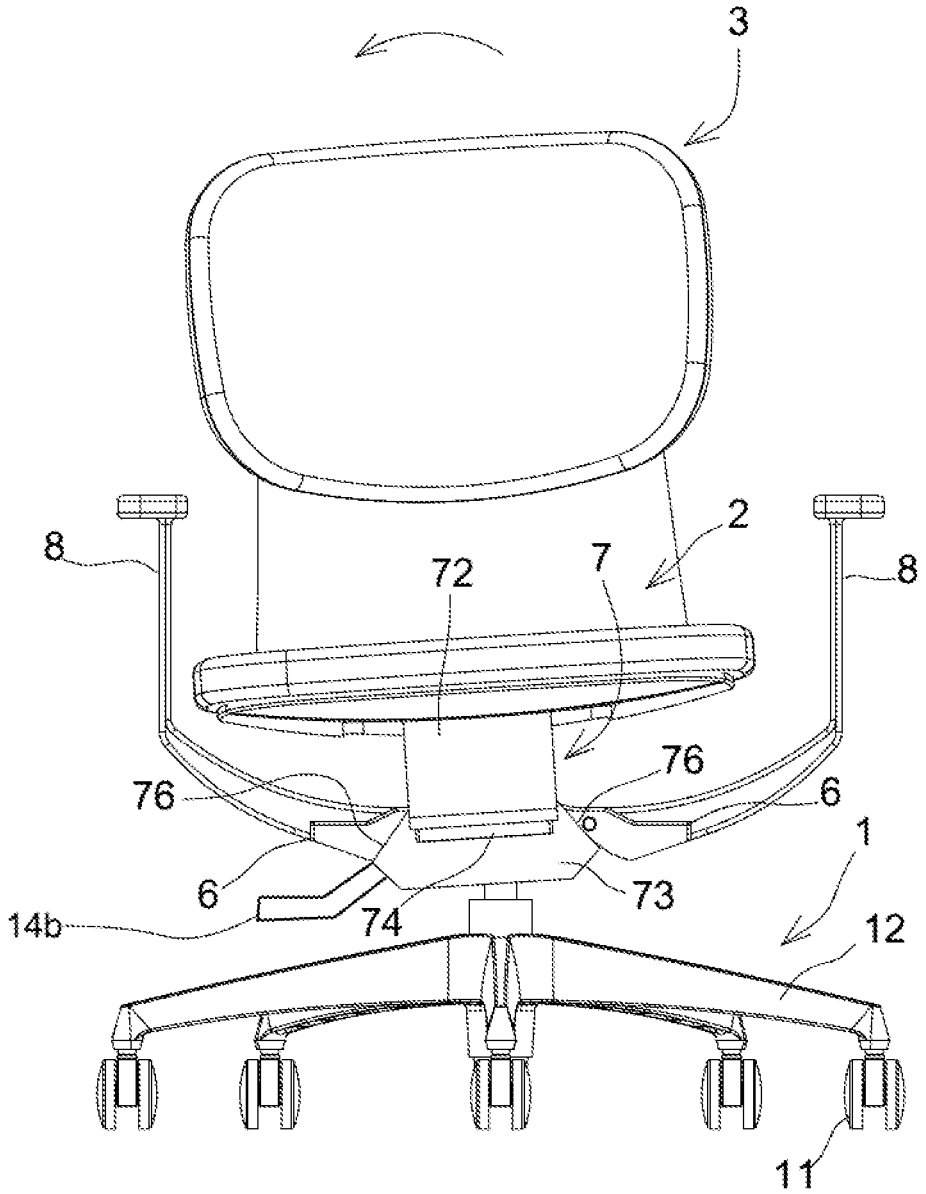
FIG. 18 is an explanatory diagram of movement according to the second embodiment of the present invention.
Figure 19:
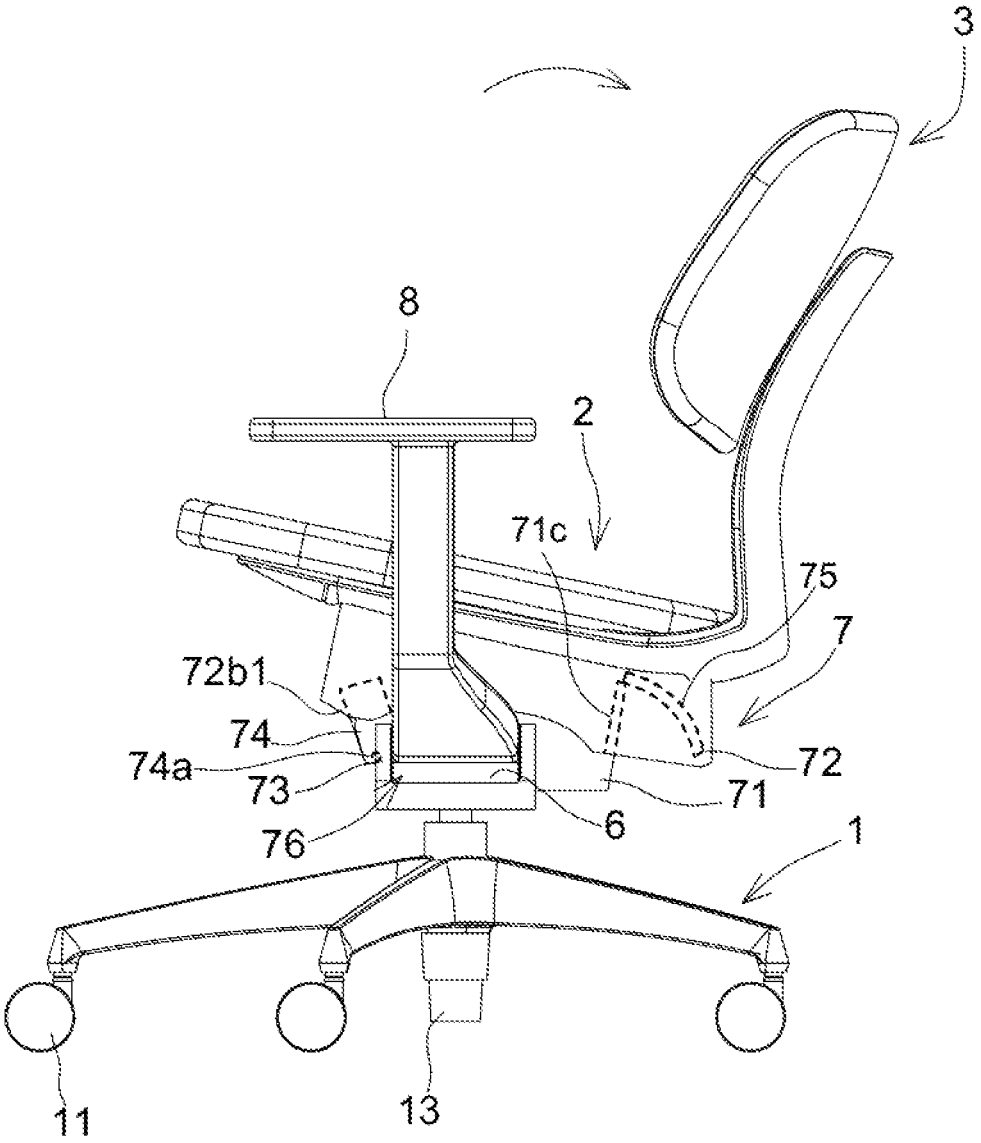
FIG. 19 is an explanatory diagram of movement according to the second embodiment of the present invention.
Figure 20:
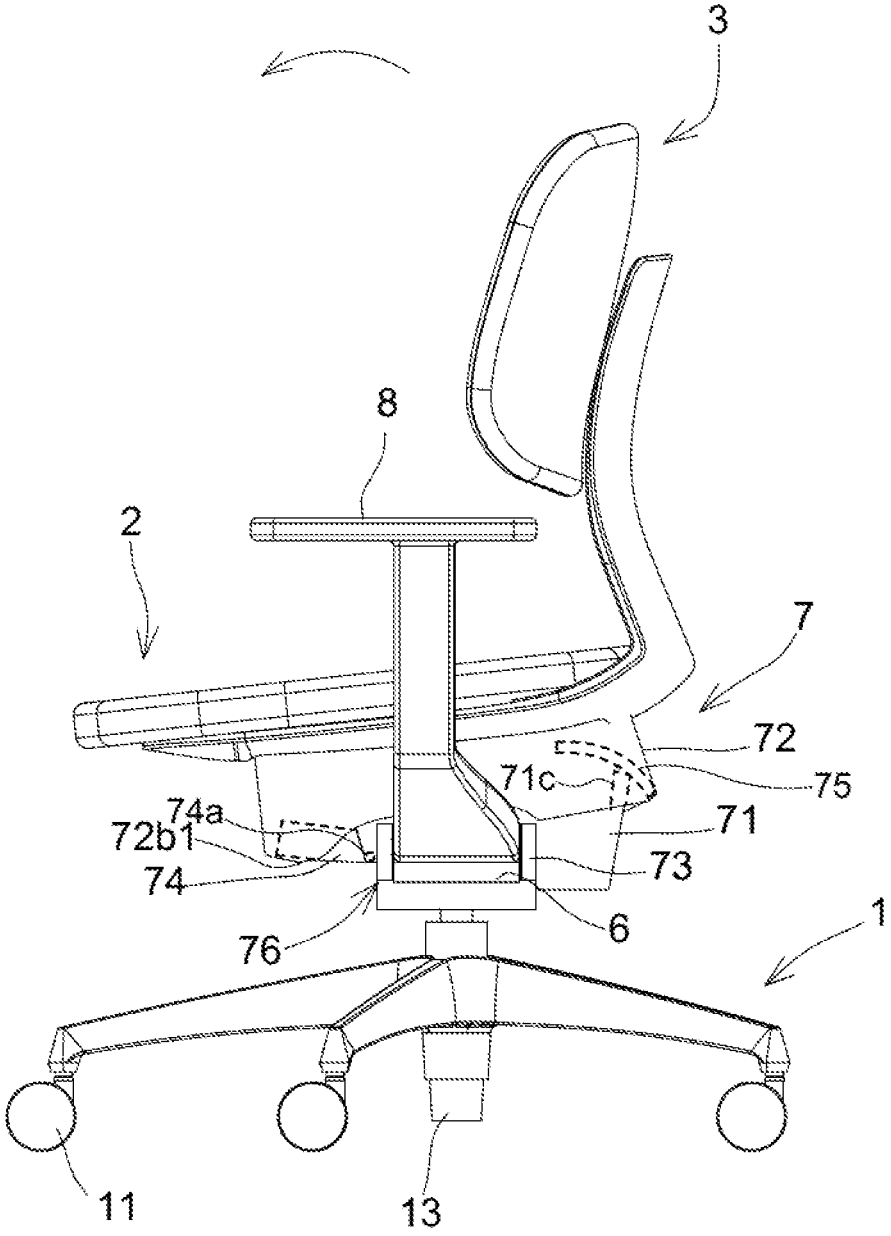
FIG. 20 is an explanatory diagram of movement according to the second embodiment of the present invention.

FIG. 13 is a perspective view of a chair according to the second embodiment. FIG. 14 is a front view of the chair according to the second embodiment. FIG. 15 is a right-side view of the chair according to the second embodiment. FIG. 16 is a lower perspective view of the chair according to the second embodiment. Also, FIG. 17 is an exploded perspective view of the chair according to the second embodiment from which the components located above the seat are removed. FIGS. 18 to 20 are explanatory diagrams of movement of the whole chair.

As illustrated in these drawings, in the same way as in the first embodiment, the chair according to the second embodiment includes the leg 1 provided to stand from a floor surface, the seat 2 and the backrest 3 that are disposed above the leg 1, the leg support pole 13 attached to the leg 1 to support the seat 2 so that the seat 2 moves up and down and can rotate, the support base 4 arranged to the upper end of the leg support pole 13 and configured to horizontally rotate integrally with the leg support pole 13 and not to move in the front-rear direction and the left-right direction in accordance with the movement following of the seat 2, the movement mechanism 5 interposed between the support base 4 and the seat 2 to support the seat 2 so that the seat 2 moves in the front-rear direction and the left-right direction, the arm attachment parts 6 supported by the support base 4, and the movable cover member 7 to cover the movement mechanism 5.

Here, in the second embodiment, a state where the arms 8 are attached to the respective arm attachment parts 6 is illustrated, and the movable cover member 7 having a different shape from that of the foregoing first embodiment is applied. The movable cover member 7 according to the second embodiment is shaped such that in particular, a rear portion is compact compared with the cover member 7 of the first embodiment.

Hereinafter, in the second embodiment, the shape of the movable cover member 7 and the behavior of the movable cover member 7 in accordance with swinging of the chair will be mainly described. It is to be noted that in the second embodiment, the through-holes 71*x*, 72*x* being the through-hole 7*x* formed in the same round hole as one of the first embodiment is formed in any of the cover members 71, 72. However, in the second embodiment, the through-hole 7*x* is not illustrated.

As illustrated in FIG. 17, the movable cover member 7 includes the left-right cover member 71 attached to the left-right support part 51, the front-rear cover member 72 attached to the front-rear support part 52, the interpolation cover member 74 interposed between a front end of the left-right cover member 71 and the front-rear cover member 72, and a back cover member 75 interposed between a rear end of the left-right cover member 71 and the front-rear cover member 72. The back cover member 75 is not provided in the first embodiment. That is, the front-rear cover member 72, the left-right cover member 71, the interpolation cover member 74, and the back cover member 75 are combined, therefore configuring the cover member 7. In addition, in accordance with movements of the plural movement parts 5A, 5B, the cover members 71, 72 move relatively in different directions in a certain area along a predetermined trajectory.

Specifically, in the second embodiment, the left-right cover member 71 includes the pair of right and left standing walls 71*a* each formed in a substantially L-shape. The left-right cover member 71 is attached to the cover attachment member 73. The cover attachment member 73 includes the pair of front and back support plates 73*a* and a connection plate 73*c* connecting between the support plates 73*a*, 73*a*. The support plate 73*a* is swingably attached to the swing ends of the respective link members 51*b* together with the shafts 51*a* as the left-right support portions.

Here, in the second embodiment, arm insertion holes 76*a* allowing insertion of the arm attachment parts 6 are formed in the side of the left-right cover member 71. Specifically, each of the arm insertion holes 76 is a substantially rectangular opening provided between each of the pair of right and left standing walls 71*a* and the connection plate 73*c*. The arm insertion hole 76 is formed to face obliquely upward.

In addition, as illustrated in FIG. 18, in accordance with the left-right swinging of the seat support walls 52*c*, the seat 2 fixed to the seat support walls 52*c* swings in the left-right direction together with the backrest 3. FIG. 18 illustrates an operation in which the seat 2 swings to the left side of FIG. 18. Likewise, obviously, the seat 2 may swing to the right of FIG. 18.

Here, the arms 8 detachably attached to the arm attachment parts 6 provided on the support base 4 do not move in accordance with the swinging of the seat 2. The left-right cover member 71 swings in the left-right direction in accordance with the movement of the left-right support part 51. Since the foregoing arm insertion holes 76 are provided, a large gap is not unnecessarily formed between the left-right cover member 71 and each of the arm attachment parts 6 and the left-right cover member 71 does not make contact with the arm attachment parts 6.

The front-rear cover member 72 is configured such that the right and left standing side walls 72*a*, the front wall 72*b*, and the back wall 72*c* standing on the back side are connected in a frame shape in planar view. The front-rear cover member 72 includes a space inside thereof in which the left-right cover member 71 can be housed. The front-rear cover member 72 is attached to the seat support walls 52*c*, and configured so that while the front-rear cover member 72 swings in the left-right direction and the front-rear direction together with the seat support walls 52*c*, the cam surfaces 52*a* and the cam followers 52*b*, both of which are the front-rear support members, are covered and hidden by the side walls 72*a* and the front wall 72*b*. In addition, as illustrated in FIGS. 16, 19 and 20, the front bottom wall 72*b*1 substantially horizontally disposed is provided at the lower end portion of the front wall 72*b*. The front bottom wall 72*b*1 is consistently contactable with a portion of the interpolation cover member 74.

In the second embodiment, each of the right and left side walls 72*a* is not formed in a reversed L-shape as in the first embodiment and is formed in a substantially rectangular shape. Therefore, a small gap is formed between the back wall 72*c* and the left-right cover member 71.

The interpolation cover member 74 is interposed between the left-right cover member 71 and the front-rear cover member 72. Specifically, as illustrated in FIGS. 16, 19 and 20, the interpolation cover member 74 is rotatably engaged though the shaft 74*a* with the upper end on the front side of the cover attachment member 73, therefore being rotatably attached in the front-rear direction.

In addition, in the second embodiment, the plate-shaped back cover member 75 having a curved shape is attached to a rear end portion of the front-rear cover member 72. The back cover member 75 serves to close the gap formed between the back wall 72*c* and the left-right cover member 71.

The left-right cover member 71 does not swing in the front-rear direction, and the front-rear cover member 72 swings in the front-rear direction. Therefore, gaps are provided between the front wall 72*b* of the front-rear cover member 72 and the front ends of the respective side walls 71*a* of the left-right cover member 71, between the back cover member 75 provided adjacent to the back wall 72*c* of the front-rear cover member 72 and the side walls 71*a* of the left-right cover member 71, and between the back cover member 75 and a rear end of the back wall 71*c* of the left-right cover member 71 such that the relative movement between the left-right cover member 71 and the front-rear cover member 72 does not cause interference therebetween.

Thus, the cover member 7 is configured such that the left-right cover member 71 and the front-rear cover member 72 move relatively close to each other with the gap.

As just described, the cover members 71, 72 moves following in accordance with the movement of the seat 2, and in addition, can cover the support mechanism 5.

Here, as illustrated in FIGS. 19 and 20, the seat 2 is configured to swing in the front-rear direction in the same way as in the first embodiment. For the front-rear movement as just described of the seat 2, in the same way as illustrated in FIG. 7, the front-rear cover member 72 swings in the front-rear direction in accordance with the front-rear swinging of the front-rear support part 52 configuring the support mechanism 5, but the left-right cover member 71 does not swing in the front-rear direction. However, in the second embodiment, the interpolation cover member 74 configured in the same manner as in the first embodiment is provided at the front end side of the left-right cover member 71 and the back cover member 75 is provided at the rear end side of the left-right cover member 71. Therefore, generation of large gaps between the front end portion of the left-right cover member 71 and the front-rear cover member 72 and between the rear end portion of the left-right cover member 71 and the front-rear cover member 72 is effectively avoided.

Furthermore, at the time of the front-rear movement of the seat 2, inside the front-rear cover member 72, the interpolation cover member 74 rotatably attached to a front end of the cover attachment member 73 rotates around the shaft 74*a* with respect to the left-right cover member. In other words, the interpolation cover member 74 rotates around the shaft 74*a* at a base end side with contacting to the front bottom wall 72*b*1 of the front-rear cover member 72 with leaning on the front bottom wall 72*b*1 at a tip end. Thus, generation of a gap between a front end portion of the left-right cover member 71 and the front-rear cover member 72 is effectively avoided.

In particular, in the second embodiment, as indicated by solid lines in FIG. 17 and by dashed lines in FIGS. 19 and 20, the back cover member 75 is fixed to the front-rear cover member 72 to be located therein adjacent to the inside rear end of the front-rear cover member 72. In addition, at the time of the front-rear swinging of the seat 2, the back cover member 75 is configured to allow the seat 2 to swing together with the front-rear cover member 72 with keeping a slight gap between the back cover member 75 and an upper end portion of the back wall 71*c* of the left-right cover member 71.

Consequently, even when the cover members 71, 72 execute a complex movement to each other, foreign objects are prevented from being trapped between the cover members 71, 72 or between the support base 4 and the cover members 71, 72.

As described above, the chair according to the present invention is a chair including a plurality of cover members 71, 72 for covering the movement mechanism 5 configured to support the seat 2 movably in at least one direction of the front-rear direction and left-right direction and the cover members 71.72 are configured to have a plurality of through-holes 7*x* arranged lengthwise and breadthwise.

With this configuration, while preventing a sitting person from touching the movement mechanism 5, even if outline of the cover members 71, 72 is increased in size or a plurality of the cover members 71, 72 are overlapped, it is possible to secure a clear see-through feeling and a light-weight feeling below the seat 2 through the through-holes 7*x* and to prevent an original appearance of the chair to which the chair is given in accordance with consumer's preference from being damaged. Furthermore, an abnormal sound can be detected at an earlier stage and a mechanical damage can be prevented.

In addition, the through-holes 7*x* are arranged on the surfaces surrounding the movement mechanism 5 and are arranged so that, when one of the through-holes 7*x* is viewed from the outer surface side, other through-holes 7*x* can be visually recognized from the inner surface side.

As the second embodiment, when there are surfaces surrounding the movement mechanism 5, a heavy-weight feeling or a blocked feeling in a wide range is easily obtained. However, when the through-holes 7*x* as illustrated are arranged, the light shining in through other through-holes 7*x* can be visually recognized and thus, the effective result of the clear see-through feeling or the light-weight feeling can be obtained.

In addition, the through-holes 7*x* are arranged so that the movement mechanism 5 can be visually recognized from the outside.

In this way, it is possible to configure a mechanical design appearance by using silhouette of the movement mechanism 5, and the position of the movement mechanism 5 is easily recognized in appearance, and thus, it can be easily designed so that the condition of movement can be checked or that the movement mechanism 5 can be oiled through the through-hole 7*x*.

Further, the size and the shape of the through-hole 7*x* are designed such that a cylinder with 8 mm in diameter cannot be inserted into the through-hole.

That is, it is believed that, as a size which does not allow fingers to easily insert into the through-hole, the size of the hole which does not allow a cylinder with 8 mm in diameter to insert into the through-hole is the best.

Further, the cover members 71,72 include the left-right cover member 71 to move in the left-right direction in accordance with the movement of the seat 2 and the front-rear cover member 72 to move in the front-rear direction in accordance with the movement of the seat 2. And the left-right cover member 71 and the front-rear cover member 72 are configured in combination, and the through-holes 7*x* (the through-holes 71*x*,72*x*) are arranged on at least one of the cover members.

If the cover members 71, 72 are configured in combination as described above, it is possible to attain miniaturization of the cover members 71, 72 compared to the cover which entirely covers.

It is to be noted that the through-holes 7*x*, that is, the through-holes 71*x*, 72*x* may be arranged in any of the cover members. In this case, however, the cover members are easily overlapped and thus, a heavy-weight feeling or a blocked feeling is easily obtained. On the other hand, when the through-holes 71*x*, 72*x* are arranged on the cover members 71, 72, respectively, the see-through feeling or the light-weight feeling is expected at the position where the through-holes 71*x*, 72*x* are communicated, and additionally, with the configuration so that the condition in which the through-holes 71*x*, 72*x* are overlapped in accordance with the movement is changed, it is possible to easily use the chair as a dynamic design.

Furthermore, the chair is configured so that the left-right cover member 71 and the front-rear cover member 72 relatively move close to each other with a gap.

When there is such a gap, it is possible to prevent an interference between the cover members 71, 72, and further, when the gap is appropriately set, it is possible to effectively prevent foreign materials from inserting between the cover members 71, 72.

Further, the through-holes 71*x*, 72*x* are arranged on at least two facing surfaces, two adjacent surfaces of the cover members 71, 72.

As described above, when the through-holes 7$x$ (the through-holes 71$x$, 72$x$) are arranged on two facing surfaces or two adjoining surfaces, especially, the light transmission properties are improved, and accordingly, high see-through feeling or light-weight feeling can be expected.

Furthermore, the through-holes 71$x$, 72$x$ are arranged on the entire surfaces of the cover members 71, 72.

As described above, when the through-holes 71$x$, 72$x$ are arranged on the entire surfaces of the cover members 71, 72, the see-through feeling or light-weight feeling can be obtained in the various angles.

In addition, when the cover members 71, 72 configuring the chair described above are only prepared, the safety of the chair can be secured and the preferable appearance thereof can be effectively realized.

It is to be noted that the concrete configuration of each of the components or members is not limited to the foregoing embodiments.

Figure 21:
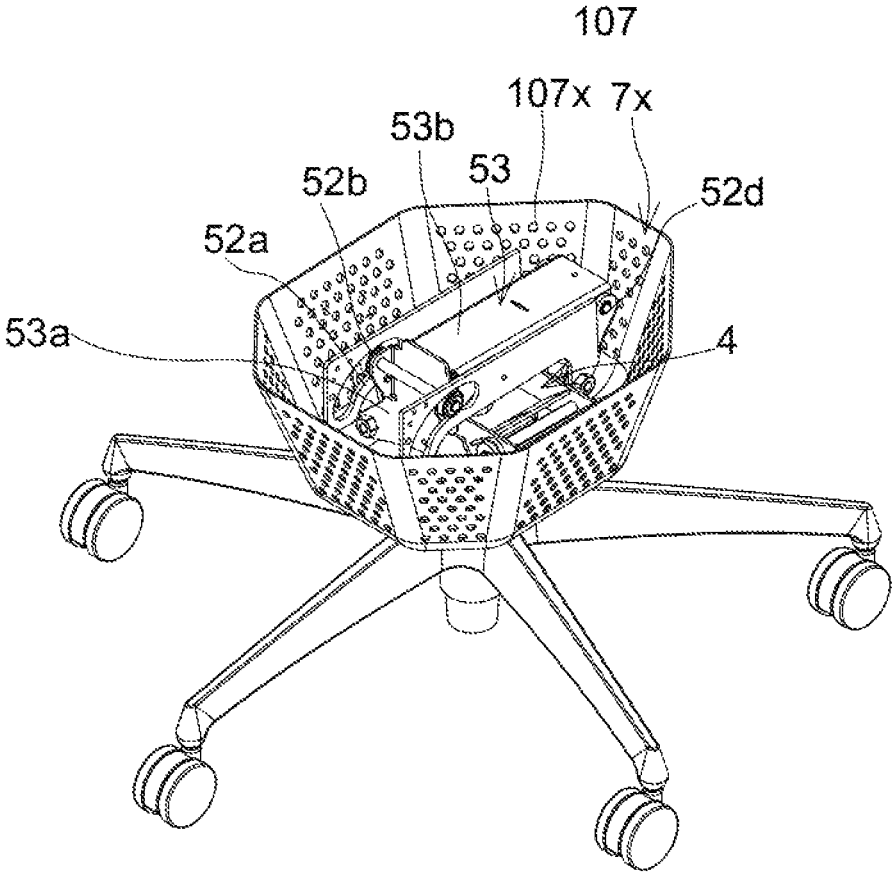
FIG. 21 is an explanatory diagram according to a modification of the present invention.

For example, in the foregoing embodiments, the mode that the through-holes 7$x$ (the through-holes 71$x$, 72$x$) are arranged on a plurality of the cover members 71, 72 was described. As illustrated in FIG. 21, it is acceptable that a single cover member 107 for covering the movement mechanism 5 configured to support the seat 2 movably at least one direction of the front-rear direction and the left-right direction is arranged, and a plurality of the through-holes 7$x$, that is, the through-holes 71$x$, 72$x$ arranged lengthwise and breadthwise on the cover member 107 at equal interval are arranged. Thar is, in the present modification, the through-holes 7$x$ are configured to be made of only through-holes 107$x$.

Even with the above configuration, while preventing the movement mechanism 5 from touching a seated person, even if outline of the cover member 107 is increased in size, it is possible to secure the clear see-through feeling and the light-weight feeling below the seat 2 through the through-holes 107$x$ and to prevent an original appearance of the chair to which the chair is given in accordance with consumer's preference from being damaged.

In this case also, the effect of the through-holes 107$x$ arranged on the surfaces surrounding the movement mechanism 5, the effect of the through-holes 107$x$ arranged so that when one of the through-holes 107$x$ is viewed from the outer surface side, other through-holes 107$x$ can be visually recognized from the inner surface side, the effect of the through-hole 107$x$ arranged so that the movement mechanism 5 can be visually recognized from the outside, and the effect of the through-holes 107$x$ arranged on the entire surfaces of the single cover members 107 are the same as those in the foregoing embodiments.

INDUSTRIAL APPLICABILITY

The present invention is applicable to a chair appropriately used in an office or the like and a cover member of the chair.

DESCRIPTION OF REFERENCE NUMERALS

2: seat
5: movement mechanism
7: cover member
71: left-right cover member
72: front-rear cover member
107: cover member
7$x$: through-hole
71$x$: through-hole
72$x$: through-hole
107$x$: through-hole

The invention claimed is:

1. A chair comprising one or a plurality of cover members for covering a movement mechanism to support a seat movably in at least one direction of a front-rear direction and a left-right direction, wherein the cover member includes a plurality of through-holes arranged, lengthwise and breadthwise, and the through-holes are arranged on surfaces surrounding the movement mechanism and also arranged so that when one of the through-holes is viewed from an outer surface side, other of the through-holes can be visually recognized from an inner surface side, wherein the cover member includes a left-right cover member to move in the left-right direction in accordance with the movement of the seat, and a front-rear cover member to move in the front-rear direction in accordance with the movement of the seat, and wherein a combination of the left-right cover member and the front-rear cover member forms the cover member, and the through-holes are arranged on at least one of the left-right and the front-rear cover members.

2. The chair according to claim 1, wherein said plurality of through-holes are arranged so that the movement mechanism can be visually recognized from the outside.

3. The chair according to claim 1, wherein each of the through-holes is designed to have such a size and shape that a cylinder with 8mm in diameter is not allowed to be inserted into each of the through-holes.

4. The chair according to claim 1, wherein the left-right cover member and the front-rear cover member relatively move close to each other with a gap.

5. The chair according to claim 1, wherein the through-holes are arranged on at least two facing surfaces of the cover member or two adjoining surfaces of the cover member.

6. The chair according to claim 5, wherein the through-holes are arranged on entire faces of the cover member.

7. A cover member configuring the chair according to claim 1.

* * * * *